US011404831B1

(12) United States Patent
Baldwin et al.

(10) Patent No.: US 11,404,831 B1
(45) Date of Patent: Aug. 2, 2022

(54) POWERED WALL PLATE

(71) Applicants: Jeffrey P. Baldwin, Anthem, AZ (US); John E. Klein, Chandler, AZ (US)

(72) Inventors: Jeffrey P. Baldwin, Anthem, AZ (US); John E. Klein, Chandler, AZ (US)

( * ) Notice: Subject to any disclaimer, the term of this patent is extended or adjusted under 35 U.S.C. 154(b) by 0 days.

(21) Appl. No.: 16/824,623

(22) Filed: Mar. 19, 2020

Related U.S. Application Data

(60) Continuation-in-part of application No. 16/655,204, filed on Oct. 16, 2019, now Pat. No. 10,630,031, which is a division of application No. 15/972,001, filed on May 4, 2018, now Pat. No. 10,574,005.

(60) Provisional application No. 62/502,763, filed on May 7, 2017, provisional application No. 62/820,366, filed on Mar. 19, 2019.

(51) Int. Cl.

| | |
|---|---|
| ***H01R 13/60*** | (2006.01) |
| ***H01R 13/74*** | (2006.01) |
| ***H01R 27/02*** | (2006.01) |
| ***H01R 13/717*** | (2006.01) |

(52) U.S. Cl.
CPC ..... *H01R 13/748* (2013.01); *H01R 13/717* (2013.01); *H01R 27/02* (2013.01)

(58) Field of Classification Search
CPC .... H01R 25/006; H01R 23/025; H01R 31/06; H01R 31/02; H01R 13/748; H01R 13/717; H01R 27/02; H02G 3/14; H02G 3/18; H02G 3/20; Y02E 60/12; H02J 7/025
USPC ..... 439/535–537, 650–652; 174/53, 55, 174/66–67; 220/241–242; 320/107–108
See application file for complete search history.

(56) References Cited

U.S. PATENT DOCUMENTS

| | | | | |
|---|---|---|---|---|
| 3,522,595 A * | 8/1970 | White | G08B 17/06 | 340/593 |
| 4,514,789 A * | 4/1985 | Jester | H01H 9/182 | 200/310 |
| 4,536,694 A * | 8/1985 | McCarty | H02J 7/0042 | 174/54 |
| 4,835,343 A | 5/1989 | Graef | | |
| 4,897,049 A * | 1/1990 | Miller | H01R 25/006 | 439/365 |
| 5,094,630 A * | 3/1992 | Jammet | H01R 31/02 | 439/652 |
| 5,384,428 A * | 1/1995 | Luu | H01R 13/6666 | 174/66 |
| 5,769,653 A * | 6/1998 | Osterbrock | H01R 13/465 | 174/66 |

(Continued)

*Primary Examiner* — Thanh Tam T Le
(74) *Attorney, Agent, or Firm* — Booth Udall Fuller, PLC; Kenneth C. Booth

(57) ABSTRACT

A powered wall plate with a plug-in module having an electrical plug and an module cover. The electrical plug has at least two electrical prongs that are configured to removably mate with an electrical receptacle. The module cover is located adjacent to the electrical plug and has a surround configured to extend around a portion of the perimeter of the wall plate, an LED light located along a bottom edge of the module cover, a USB port exposed on a surface of the module cover, and a circuit contained within the module cover and configured to supply power to the USB port and the LED light when power is supplied to the electrical prongs. The wall plate has a first mounting screw aperture and the plug-in module has a second mounting screw aperture that receive a mounting screw, attaching the plug-in module to the wall plate and the electrical device.

19 Claims, 46 Drawing Sheets

(56) References Cited

U.S. PATENT DOCUMENTS 5,932,845 A * 8/1999 Lacy ..... H02G 3/14 174/67
6,297,450 B1 * 10/2001 Yu ..... H02G 3/14 174/480
6,423,900 B1 7/2002 Soules
6,674,003 B1 * 1/2004 Torres ..... H02G 3/14 174/66
6,897,381 B2 * 5/2005 He ..... A01M 1/2072 174/66
6,977,341 B1 12/2005 Gustaveson, II
6,981,896 B2 1/2006 Su
7,140,922 B2 * 11/2006 Luu ..... H01R 31/065 439/651
7,167,078 B2 * 1/2007 Pourchot ..... H01R 13/7038 340/10.1
7,247,793 B2 * 7/2007 Hinkson ..... H01R 31/06 174/66
7,271,339 B2 9/2007 Dinh
7,833,037 B2 11/2010 Reusche
7,896,702 B2 3/2011 Stiehl
7,902,458 B2 * 3/2011 Eshelman ..... H02G 3/14 174/66
7,930,118 B2 * 4/2011 Vinden ..... G01R 22/065 702/64
8,456,131 B2 * 6/2013 Bukow ..... H02J 7/0044 320/111
8,834,210 B2 * 9/2014 Brausen ..... H01R 13/7135 439/718
8,864,517 B2 * 10/2014 Cohen ..... G06F 1/1632 439/536
8,912,442 B2 12/2014 Smith
9,362,728 B2 6/2016 Smith
D781,241 S * 3/2017 Knight ..... D13/156
9,825,414 B2 11/2017 Armstrong
10,161,806 B2 * 12/2018 Lermann ..... H01R 31/065
10,505,326 B2 * 12/2019 Chien ..... H01R 13/70
2004/0142601 A1 * 7/2004 Luu ..... H01R 33/88 439/652

* cited by examiner

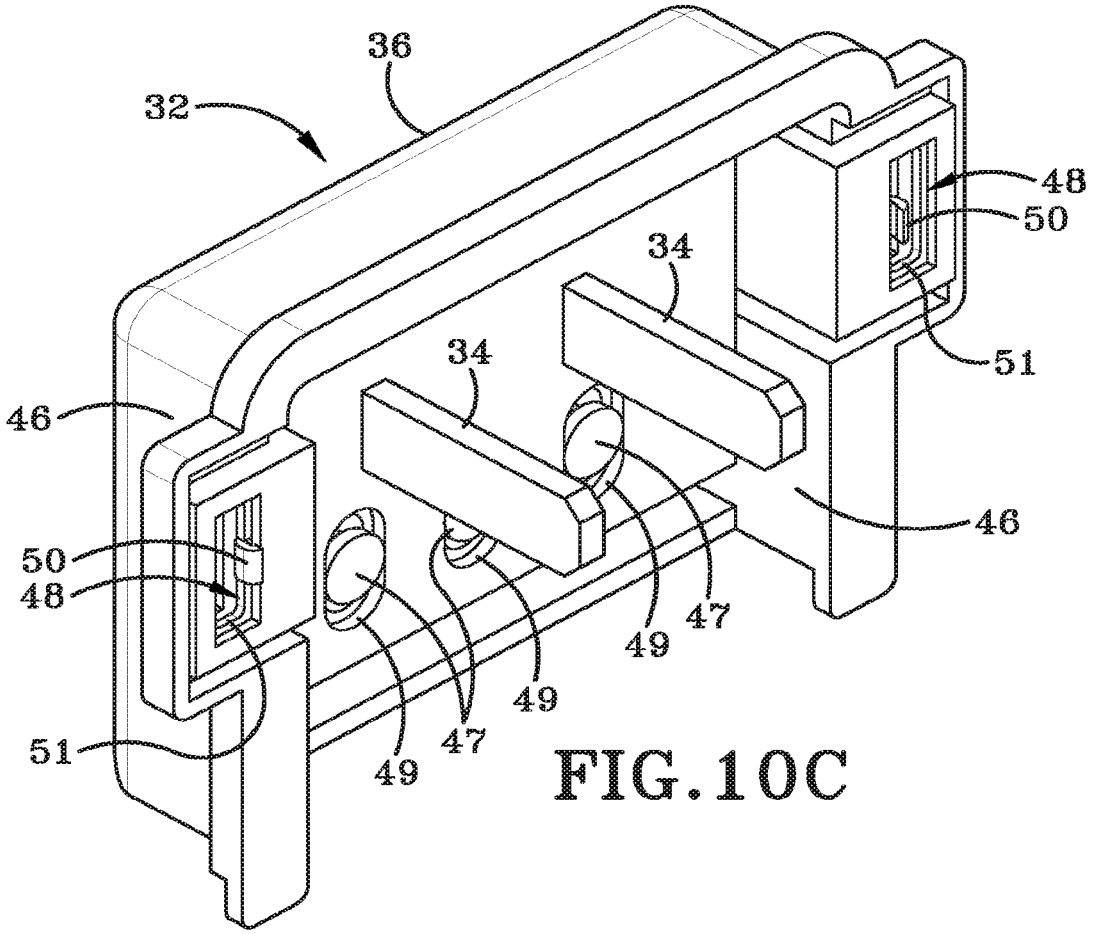
FIG.10C
FIG.10D
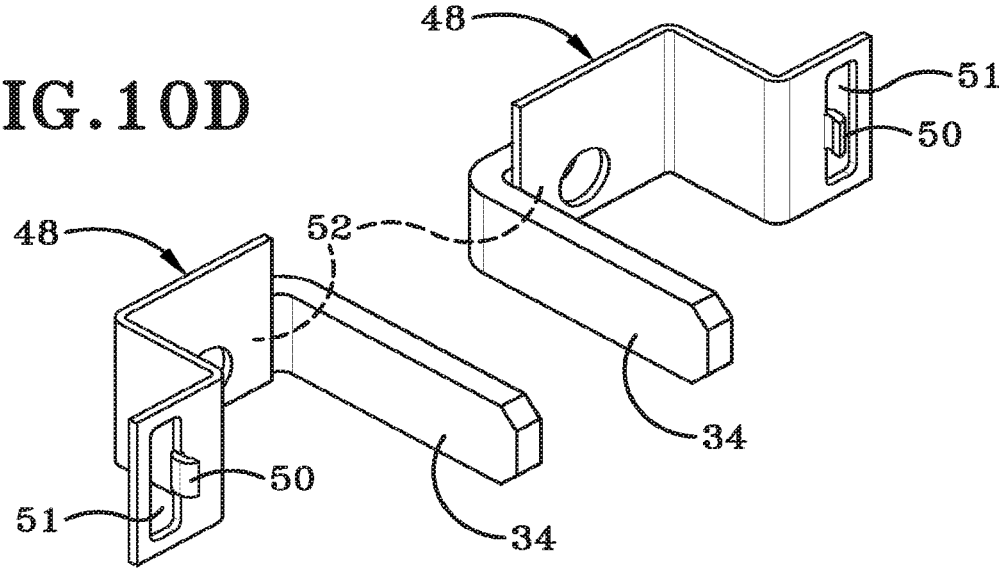

POWERED WALL PLATE

RELATED APPLICATIONS

This application is a continuation-in-part application of U.S. Utility patent application Ser. No. 16/655,204 entitled "Powered Wall Plate" to Jeffrey P. Baldwin, filed on Oct. 16, 2019, now pending, which application is a divisional application of U.S. Utility patent application Ser. No. 15/972,001 entitled "Powered Wall Plate" to Jeffrey P. Baldwin, filed on May 4, 2018, which issued as U.S. Pat. No. 10,574,005 on Feb. 25, 2020, which application claims the benefit of the filing date of U.S. Provisional Patent Application 62/502,763 entitled "Powered Wall Plate" to Jeffrey P. Baldwin that was filed on May 7, 2017, the contents of which are hereby incorporated by this reference. This application also claims the benefit of the filing date of U.S. Provisional Patent Application 62/820,366 entitled "Powered Wall Plate Attachment" to Jeffrey P. Baldwin, filed on Mar. 19, 2019, the contents of which are hereby incorporated by this reference.

BACKGROUND

1. Technical Field

Aspects of the present disclosure relate generally to wall plates and wall plates which are electrically active and receive and/or convey electrical current.

2. Background Art

Wall plates are well known and are used to fill in the space between an electrical box and an electrical device. Specifically, the wall plates are known to provide a more aesthetically pleasing appearance while also preventing access to the electrical device. By preventing access to the electrical device, the user is safer because electrical wiring is not readily accessible.

Wall plates are also known to provide a simple lighting source or powering portable devices USB, but are commonly unsafe and rely on direct, spring biased connections with an installed electrical receptacle. These spring biased electrical connections are unsafe due to the inherent unreliability of the spring biased connections which may short or become damaged over time, leading to electrical and/or fire hazards.

SUMMARY

Aspects of this disclosure relate to a powered wall plate. In one aspect, a wall plate including a body having a front surface opposite a rear surface and at least one opening extending through the front surface and the rear surface, at least two electrical contacts on the rear surface, at least one wire removably connected to each of the at least two electrical contacts to supply electrical current from an electrical device positioned behind the wall plate.

In another aspect, a wall plate includes a body having a front surface opposite a rear surface and at least one opening extending through the front surface and the rear surface, an electrical contact on the rear surface, a plug-in module having an electrical prong extending rearward and a current transfer feature in electrical communication with the electrical prong, wherein the current transfer feature engages with the electrical contact on the rear surface to convey electrical current from the plug-in module to the electrical contact on the rear surface.

In an implementation, the wall plate may include a female electrical receptacle aperture on a surface opposite the electrical prong of the plug-in module. The plug-in module may include a plug-in module through hole aligned with a wall plate through hole. The installer may selectively utilize the plug-in module or a removable electrical wire to provide electrical current to the wall plate. The wall plate may further include at least one USB aperture, a light, or a photoelectric cell. The plug-in module current transfer feature may extend outward from a surface adjacent the electrical prong. The current transfer feature may be two current transfer features.

The plug-in module current transfer feature may further include an aperture or a protrusion. The plug-in module current transfer feature may further include a slideable member oriented to connect to electrical devices having different dimensions. The slideable member may move vertically to align with an aperture in an electrical receptacle installed in an electrical box. The plug-in module may further include a stop mechanism to limit travel of the slideable member in two directions. The wall plate may further include a plug-in module spacer positioned on the electrical prong to space the plug-in module from an electrical device. The plug-in module spacer may be spring biased to the extended position. The plug-in module may be molded integral with the wall plate. The plug-in module may be a separate component connected to the wall plate upon installation.

In another aspect, a wall plate includes a body having a front surface opposite a rear surface and at least one opening extending through the front surface and the rear surface and a body aperture for receiving a mounting screw, an electrical contact on the rear surface, a plug-in module having an electrical prong extending rearward and an aperture aligned with the body aperture for receiving the mounting screw, and wherein the mounting screw connects through the body aperture and the plug-in module aperture with an electrical device or an electrical box.

In an implementation, the plug-in module may further include a female electrical receptacle on a surface opposite the electrical prong. The female electrical receptacle aperture may be longitudinally aligned with the electrical prong. The plug-in module extends outward beyond the electrical wall plate.

Aspects of this document relate to a powered wall plate which may comprise a plug-in module configured to couple to a wall plate having a front surface opposite a rear surface, at least one opening extending through the front surface and the rear surface that is large enough to expose an electrical device therethrough, and a first mounting screw aperture extending through the wall plate and configured to receive a mounting screw to attach the wall plate to the electrical device, the plug-in module configured to extend forward from the front surface when mounted to the wall plate, the plug-in module having an electrical plug having at least two electrical prongs extending back toward the electrical device, the at least two electrical prongs configured to removably mate with an electrical receptacle of the electrical device a module cover coupled to and located adjacent to the electrical plug, the module cover having a surround configured to extend around a bottom edge and a portion of a right edge and a left edge of the wall plate when the plug-in module is mounted to the wall plate, an LED light located along a bottom edge of the module cover, a USB port exposed on a side surface of the module cover and facing perpendicular to the front surface, and a circuit contained within the module cover, the circuit electrically coupled to the USB port, the at least two electrical prongs, and the LED light and configured to provide power to the USB port and the LED light when power is supplied to the at least two electrical prongs, and a second mounting screw aperture extending through the plug-in module, the second mounting screw aperture configured to receive the mounting screw to attach the plug-in module to the wall plate and the electrical device, wherein the distance between an electrical plug front surface and the front surface of the wall plate is smaller than the distance between a module cover front surface and the front surface of the wall plate when the plug-in module is mounted to the wall plate.

Particular embodiments may comprise one or more of the following features. The second mounting screw aperture may be located above the electrical plug. The second mounting screw aperture may be located in the module cover adjacent to the electrical plug. The module cover may be located below the electrical plug.

Aspects of this document relate to a powered wall plate which may comprise a plug-in module, the plug-in module having an electrical plug having at least two electrical prongs extending away from the electrical plug, the at least two electrical prongs configured to removably mate with an electrical receptacle of an electrical device, a module cover coupled to and located adjacent to the electrical plug, the module cover having a surround configured to extend around a portion of the perimeter of a wall plate surrounding the electrical device when the plug-in module is mated with the electrical receptacle and a circuit contained within the module cover, the circuit electrically coupled to the at least two electrical prongs, and a second mounting screw aperture extending through the plug-in module, the second mounting screw aperture configured to receive a mounting screw to attach the plug-in module to the electrical device and to the wall plate, wherein the wall plate has a front surface and the distance between an electrical plug front surface and the front surface of the wall plate is smaller than the distance between an electrical box front surface and the front surface of the wall plate when the plug-in module is mated with the electrical receptacle.

Particular embodiments may comprise one or more of the following features. The electrical box may further have an LED light located along an edge of the electrical box. The LED light may be located along a bottom edge of the electrical box. The electrical box may further have a USB port exposed on a surface of the electrical box. The USB port may be exposed on a surface perpendicular to the front surface. The surround may be configured to extend around a bottom edge and a portion of a right edge and a left edge of the wall plate when the plug-in module is mated with the electrical receptacle.

Aspects of this document relate to a powered wall plate which may comprise a plug-in module, the plug-in module having an electrical plug having at least two electrical prongs extending away from the electrical plug, the at least two electrical prongs configured to removably mate with an electrical receptacle of an electrical device and an electrical box located adjacent to the electrical plug, the electrical box having a surround configured to extend around a portion of the perimeter of a wall plate surrounding the electrical device when the plug-in module is mated with the electrical receptacle, and a circuit contained within the electrical box, the circuit electrically coupled to the at least two electrical prongs.

Particular embodiments may comprise one or more of the following features. The plug-in module may further have a second mounting screw aperture extending through the plug-in module, the second mounting screw aperture configured to receive a mounting screw to attach the plug-in module to the wall plate and to the electrical device when the plug-in module is mated with the electrical receptacle. The second mounting screw aperture may be located above the electrical plug. The second mounting screw aperture may be located in the electrical box adjacent to the electrical plug. The surround may be configured to extend around a bottom edge and a portion of a right edge and a left edge of the wall plate when the plug-in module is mated with the electrical receptacle. The wall plate may have a front surface and the distance between an electrical plug front surface and the front surface of the wall plate is smaller than the distance between an electrical box front surface and the front surface of the wall plate when the plug-in module is mated with the electrical receptacle. The electrical box may further have a light located along an edge of the electrical box. The light may be located along a bottom edge of the electrical box. The electrical box may further have a USB port exposed on a surface of the electrical box. The USB port may be exposed on a surface perpendicular to the front surface.

Aspects and applications of the disclosure presented here are described below in the drawings and detailed description. Unless specifically noted, it is intended that the words and phrases in the specification and the claims be given their plain, ordinary, and accustomed meaning to those of ordinary skill in the applicable arts. The inventors are fully aware that they can be their own lexicographers if desired. The inventors expressly elect, as their own lexicographers, to use only the plain and ordinary meaning of terms in the specification and claims unless they clearly state otherwise and then further, expressly set forth the "special" definition of that term and explain how it differs from the plain and ordinary meaning. Absent such clear statements of intent to apply a "special" definition, it is the inventors' intent and desire that the simple, plain and ordinary meaning to the terms be applied to the interpretation of the specification and claims.

The inventors are also aware of the normal precepts of English grammar. Thus, if a noun, term, or phrase is intended to be further characterized, specified, or narrowed in some way, then such noun, term, or phrase will expressly include additional adjectives, descriptive terms, or other modifiers in accordance with the normal precepts of English grammar. Absent the use of such adjectives, descriptive terms, or modifiers, it is the intent that such nouns, terms, or phrases be given their plain, and ordinary English meaning to those skilled in the applicable arts as set forth above.

The foregoing and other aspects, features, and advantages will be apparent to those artisans of ordinary skill in the art from the DESCRIPTION and DRAWINGS, and from the CLAIMS.

BRIEF DESCRIPTION OF THE DRAWINGS

Embodiments of the present invention will hereinafter be described in conjunction with the appended drawings, where like designations denote like elements, and:

FIG. 10C is a rear perspective view of the plug-in module.

FIG. 10D is a view of the plug-in module current transfer unit.

DETAILED DESCRIPTION

Figure 1:
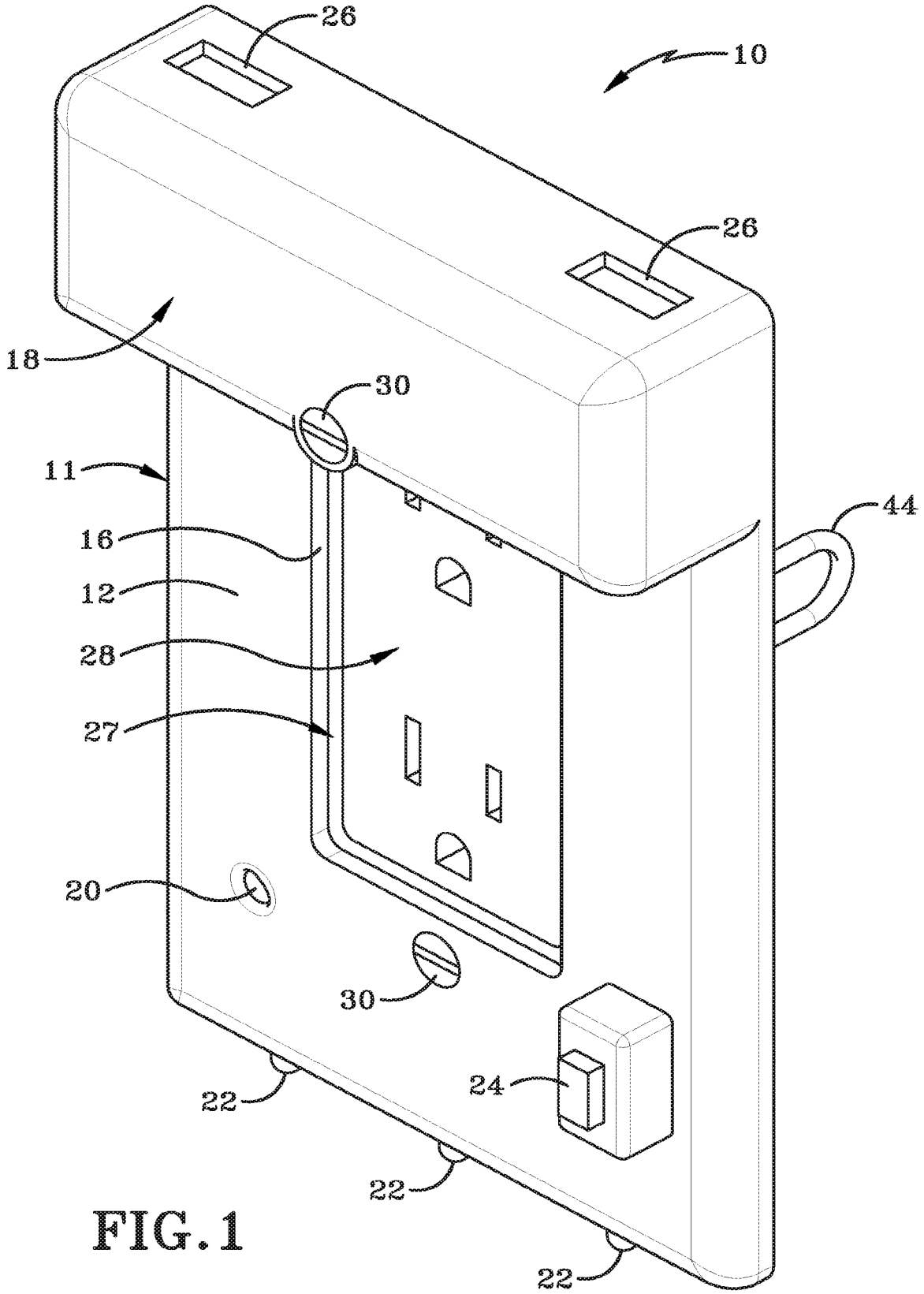
FIG. 1 is a perspective view of a first embodiment powered wall plate.
Figure 2:
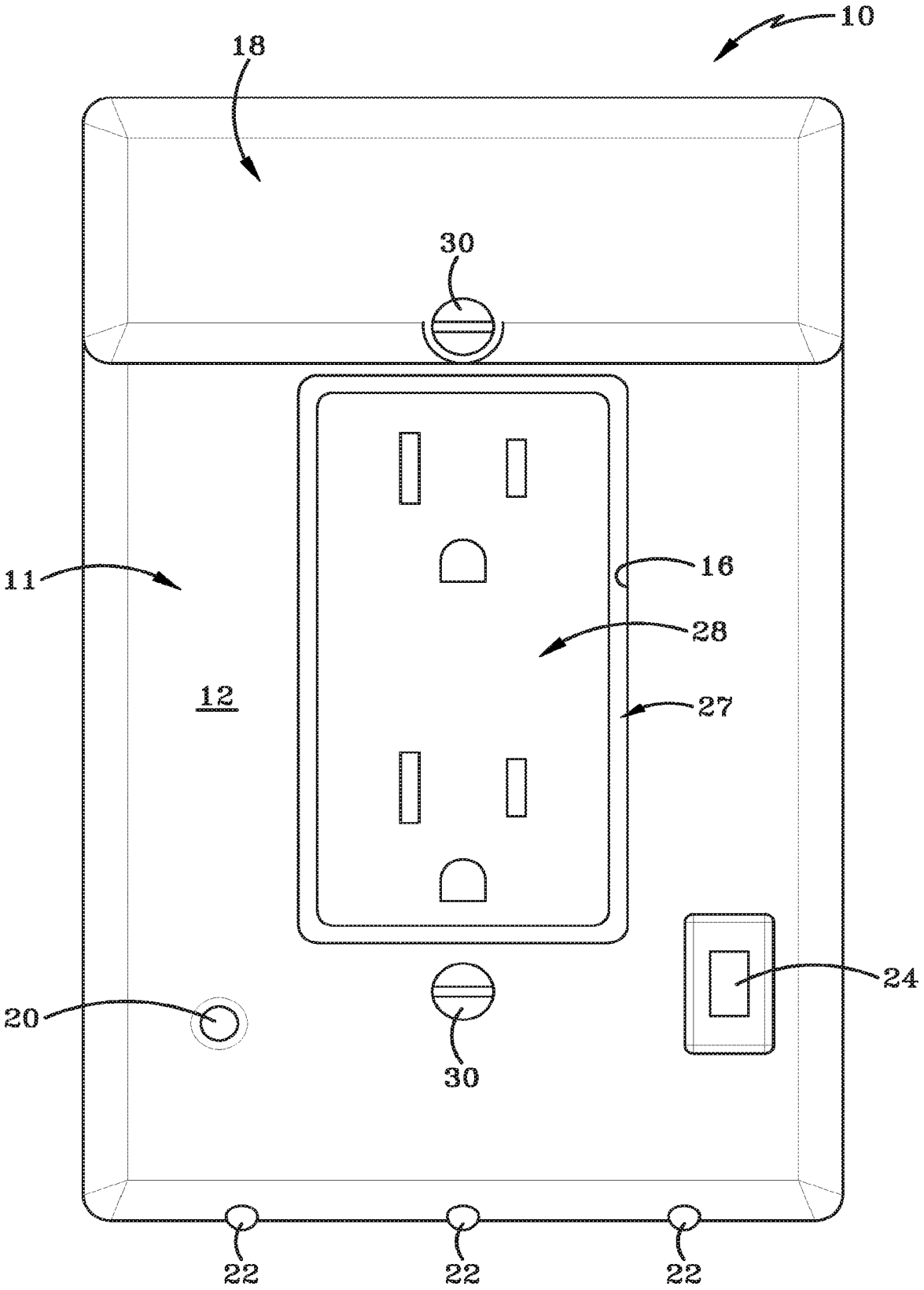
FIG. 2 is a front view of the powered wall plate.
Figure 3:
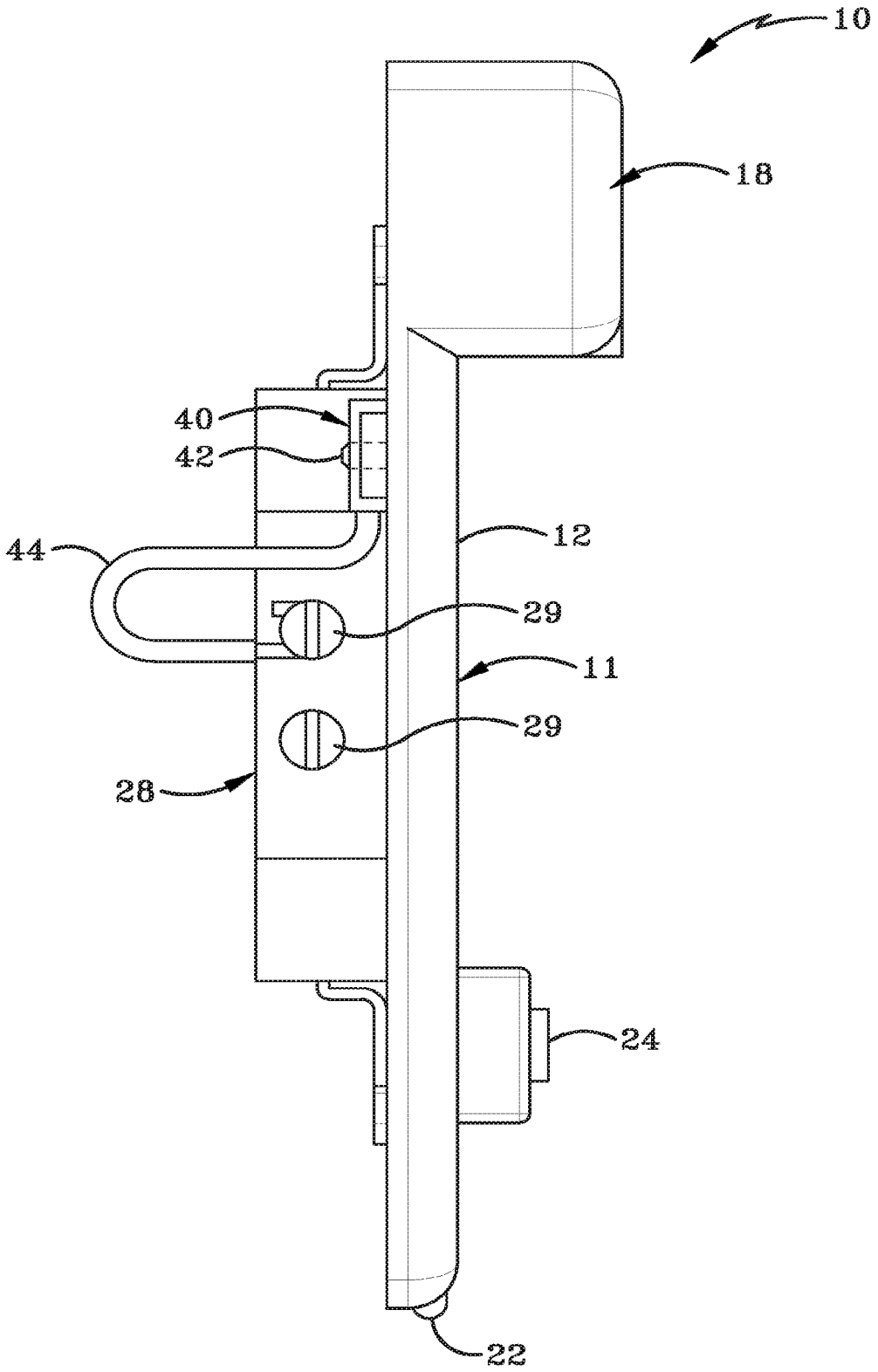
FIG. 3 is a left side view of the powered wall plate.
Figure 4:
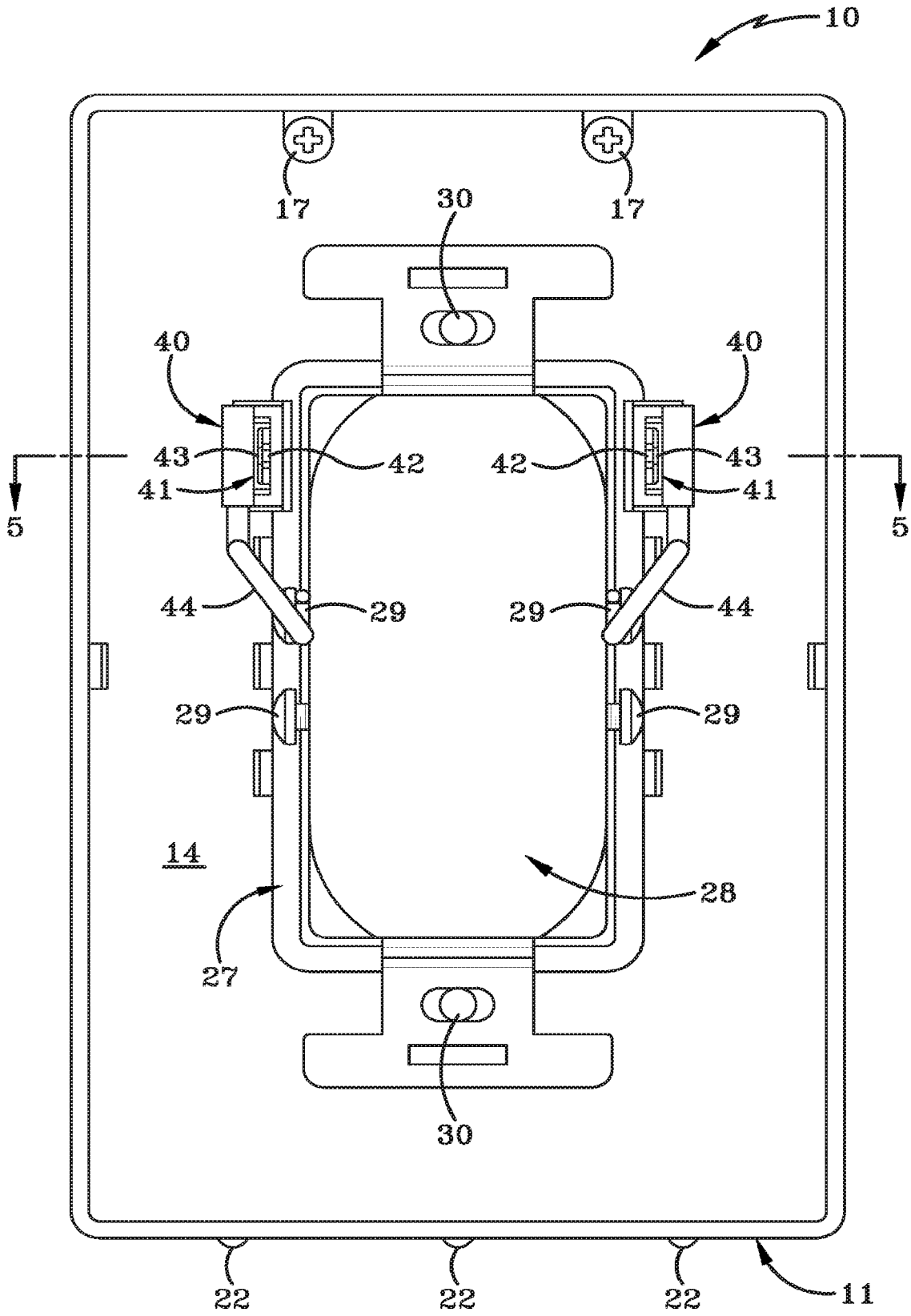
FIG. 4 is a rear view of the powered wall plate.

This disclosure, its aspects and implementations, are not limited to the specific components or assembly procedures disclosed herein. Many additional components and assembly procedures known in the art consistent with the intended operation and assembly procedures for a powered wall plate will become apparent for use with implementations of a powered wall plate from this disclosure. Accordingly, for example, although particular components are disclosed, such components and other implementing components may comprise any shape, size, style, type, model, version, measurement, concentration, material, quantity, and/or the like as is known in the art for such implementing components, consistent with the intended operation of a powered wall plate.

FIGS. 1 through 6 illustrate a first embodiment powered wall plate 10 having a body 11 with a front surface 12 and a rear surface 13. The powered wall plate may include a back plate 14 positioned behind rear surface 13 and secured in place with a plurality of screws 17. An opening 16 extends through the front surface 12 and the rear surface 13 to allow an electrical device 28 to be accessible. A transformer portion 18 maybe positioned on the top, bottom or sides of the powered wall plate and includes a circuit board 15 operatively arranged to control inputs and outputs for a photocell 20, LED or other suitable lights 22, a control switch (on/off/auto) 24, and power USB ports 26. Additional components or features may readily be included without departing from the spirit and scope of the present disclosure.

Powered wall plate 10 is secured to electrical device 28 or the electrical box with screws 30 and an adapter 27 which is complimentary shaped to the electrical device 28. For example, since electrical device 28 may be shaped or sized differently, an appropriate adapter will be utilized. Electrical device 28 includes current mounting screws 29 which are adapted to receive electrical wires 44. Electrical wires 44 connect at current mounting screws 29 and hard wire current transfer plug 40 which connects to wall plate current feature 42.

Moving to hard wire current transfer plug 40 in more detail, an electrode transfer portion 41 includes a current transfer contact 43 which is secured within the housing of current transfer plug 40 for each current path. Accordingly the current transfer plug can easily slide onto wall plate current feature 42 to securely and efficiently transfer electrical current from wire 44 and ultimately electrical device 28 to the wall plate through wall plate current feature 42 and into a wall plate interface 39 as seen in FIG. 6 with the current transfer plug 40 disconnected from wall plate current feature 42 and then connected in FIG. 5. Wall plate interface 39 then carries current to circuit board 15 to activate the LED lights, USB Power, control circuit, photocell, and any other features included on the powered wall plate.

Figure 5:
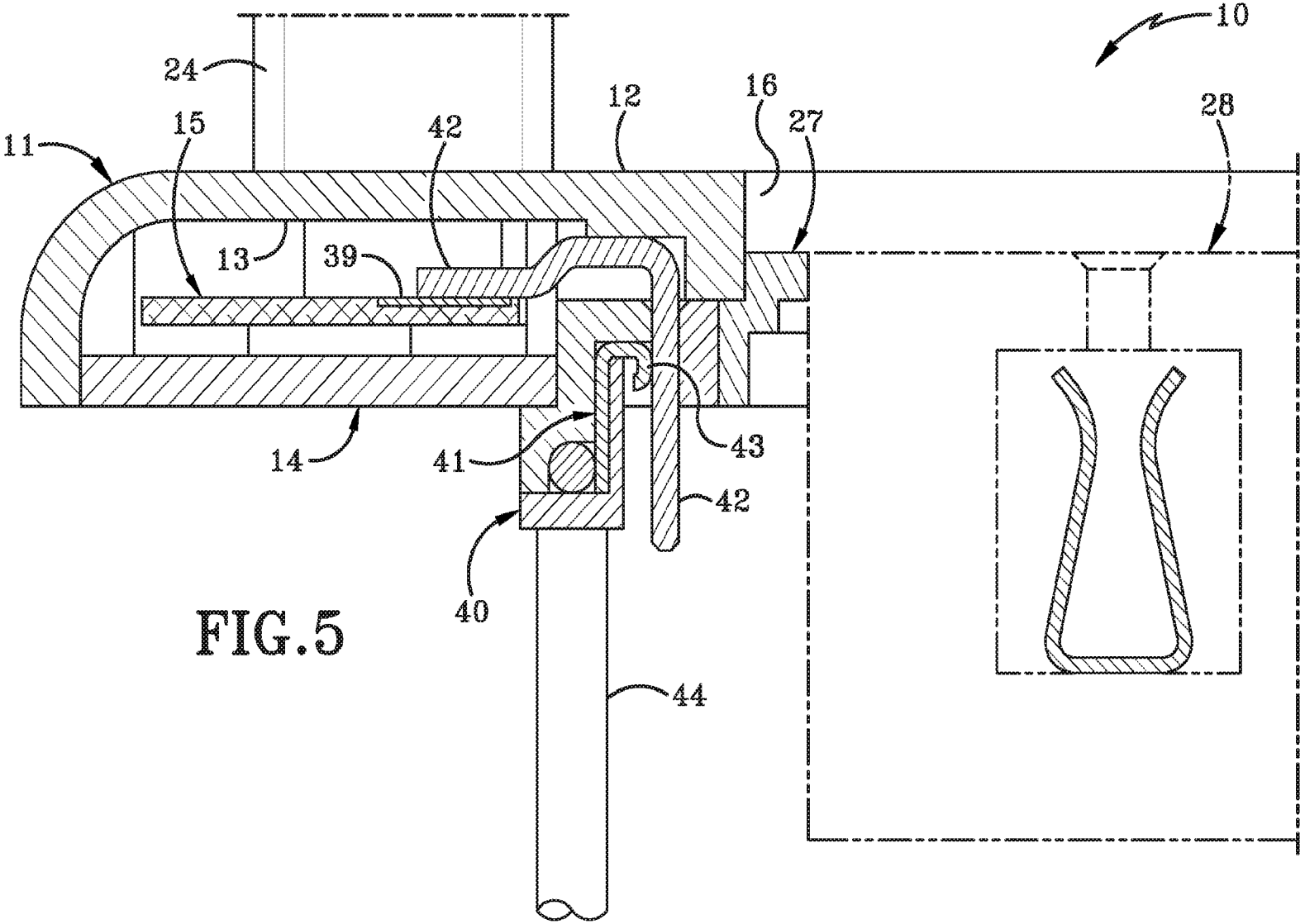
FIG. 5 is a sectional view taken generally about line 5-5 in FIG. 4.
Figure 5A:
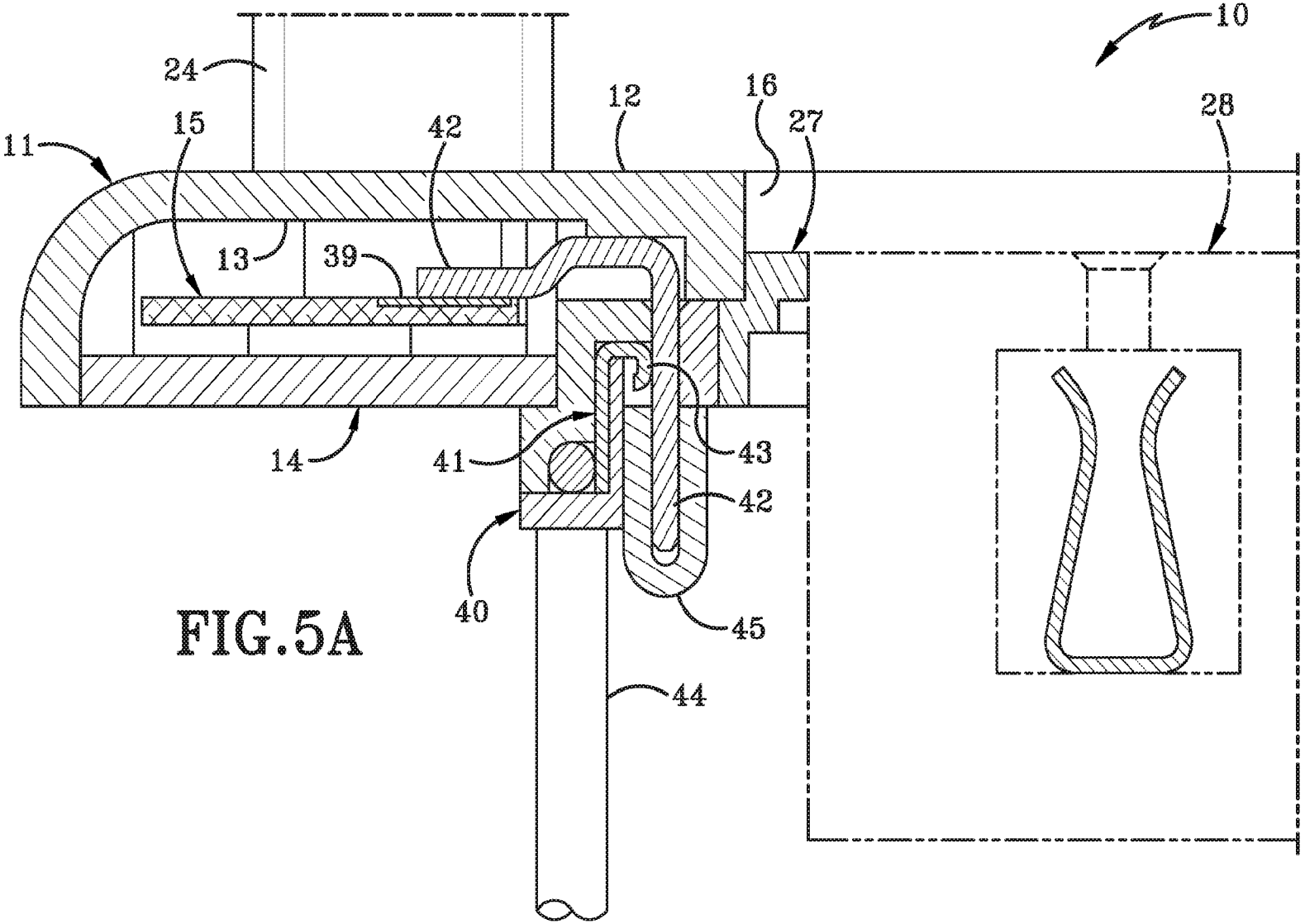
FIG. 5A is a sectional view taken generally about line 5-5 in FIG. 4 and including a cap.
Figure 6:
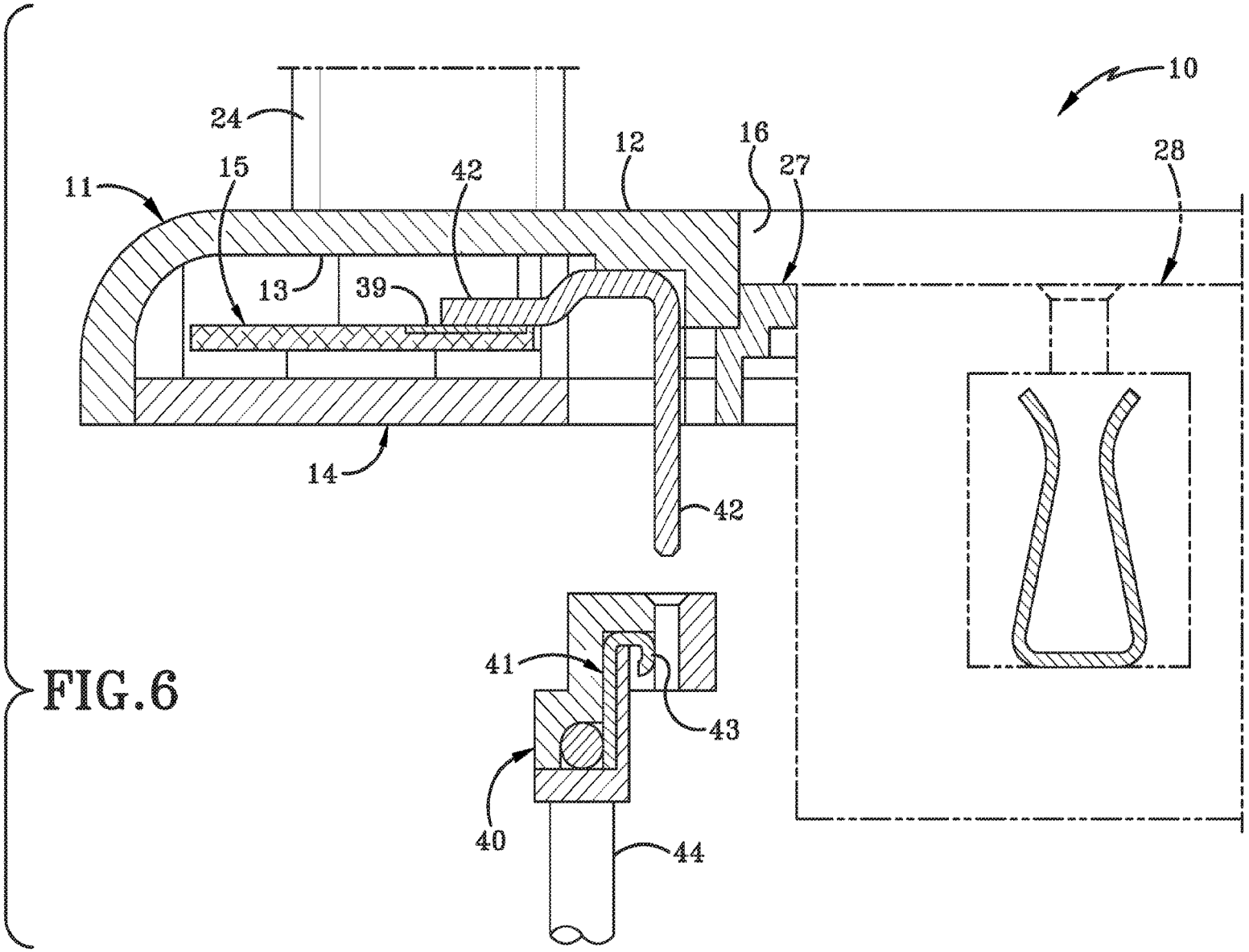
FIG. 6 is a sectional view taken generally about line 5-5 in FIG. 5 with the hardwire current transfer plug disconnected.

FIG. 5 illustrates a similar current transfer plug 40 which includes an additional cap 45. Cap 45 is structured and oriented so that it can fit over wall plate current feature 42 after current transfer plug 40 is positioned securely on wall plate current feature 42. In this orientation, cap 45 functions to significantly reduce the risk of electrical shock or electrical shorts from wires contact an exposed conductor as well as reducing the likelihood that current transfer plug 40 may be inadvertently removed.

Installation of the hard wired powered wall plate 10 is simple in that the installer removes the original wall plate and unscrews the electrical device mounting screws. Next, electrical wire 44 is connected to the electrical device current mounting screws 29 and reinstalls electrical device 28 within an electrical box. The current transfer plug 40 on the other end of electrical wire 44 is then connected to each wall plate current feature 42 before the powered wall plat 10 is secured with screws 30. The installer may then reenergize the circuit and have USB power, lighting, and control of the electrical current provided to wall plate 10. In one implementation, the installer may include an adapter around the opening 16 of the wall plate depending on the electrical device 28 used and may install a cap 45 to prevent electrocution or electrical shorts.

Advantageously, the powered wall plate can include any number of circuits to provide any number of usable features within the spirit and scope of the present disclosure. While examples include USB ports, LED lighting, a photocell, a control circuit, or the like, any suitable input, output, or control circuit may be implemented in the powered wall plate. Still further, the hard wire option shown in FIGS. 1-6 provides the advantage of using electrical current from the electrical device 28 securely and safely with electrical wires while still allowing all the electrical device apertures to be free and used from other appliances or components.

Figure 7:
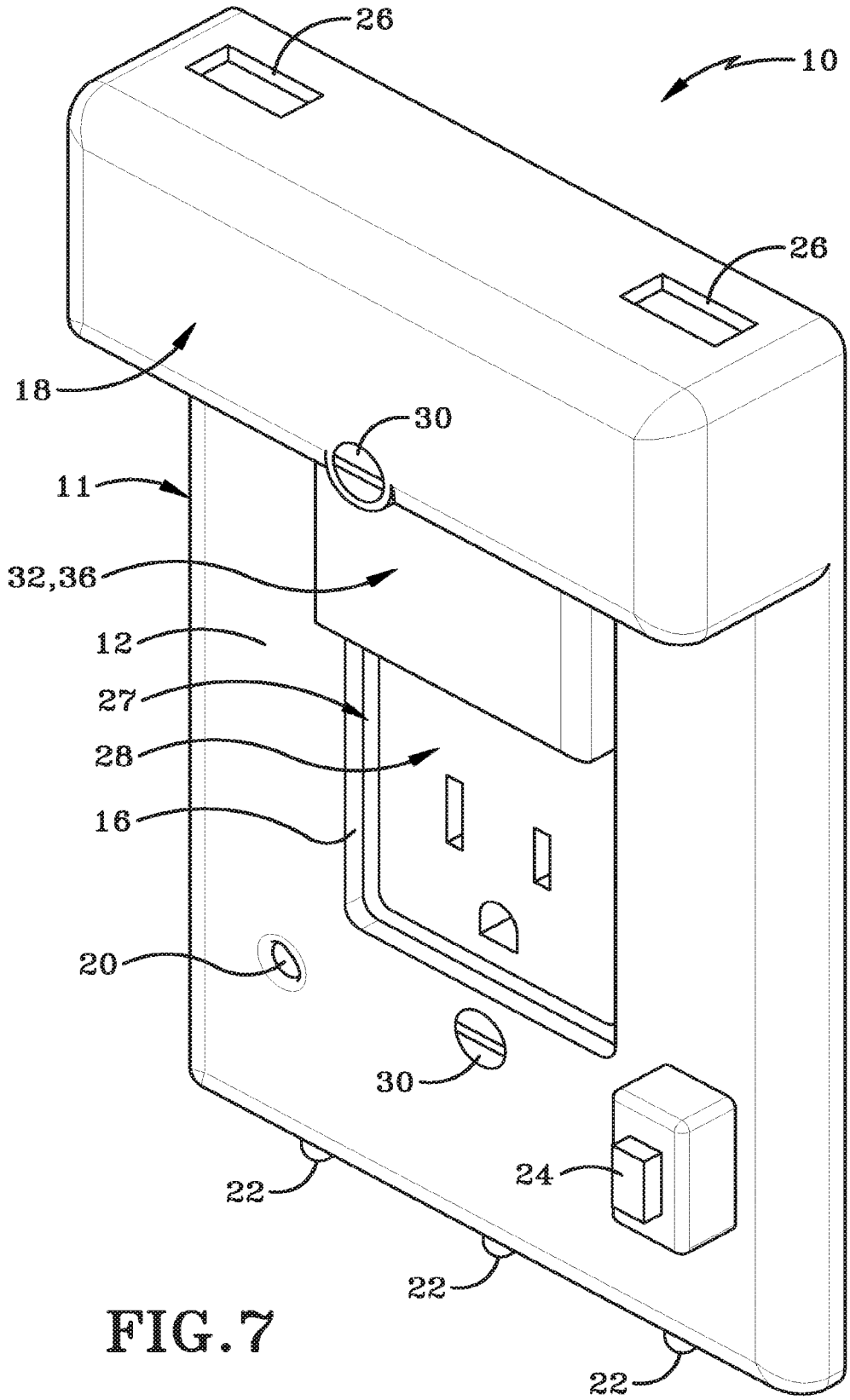
FIG. 7 is a perspective view of a second embodiment powered wall plate.
Figure 7A:
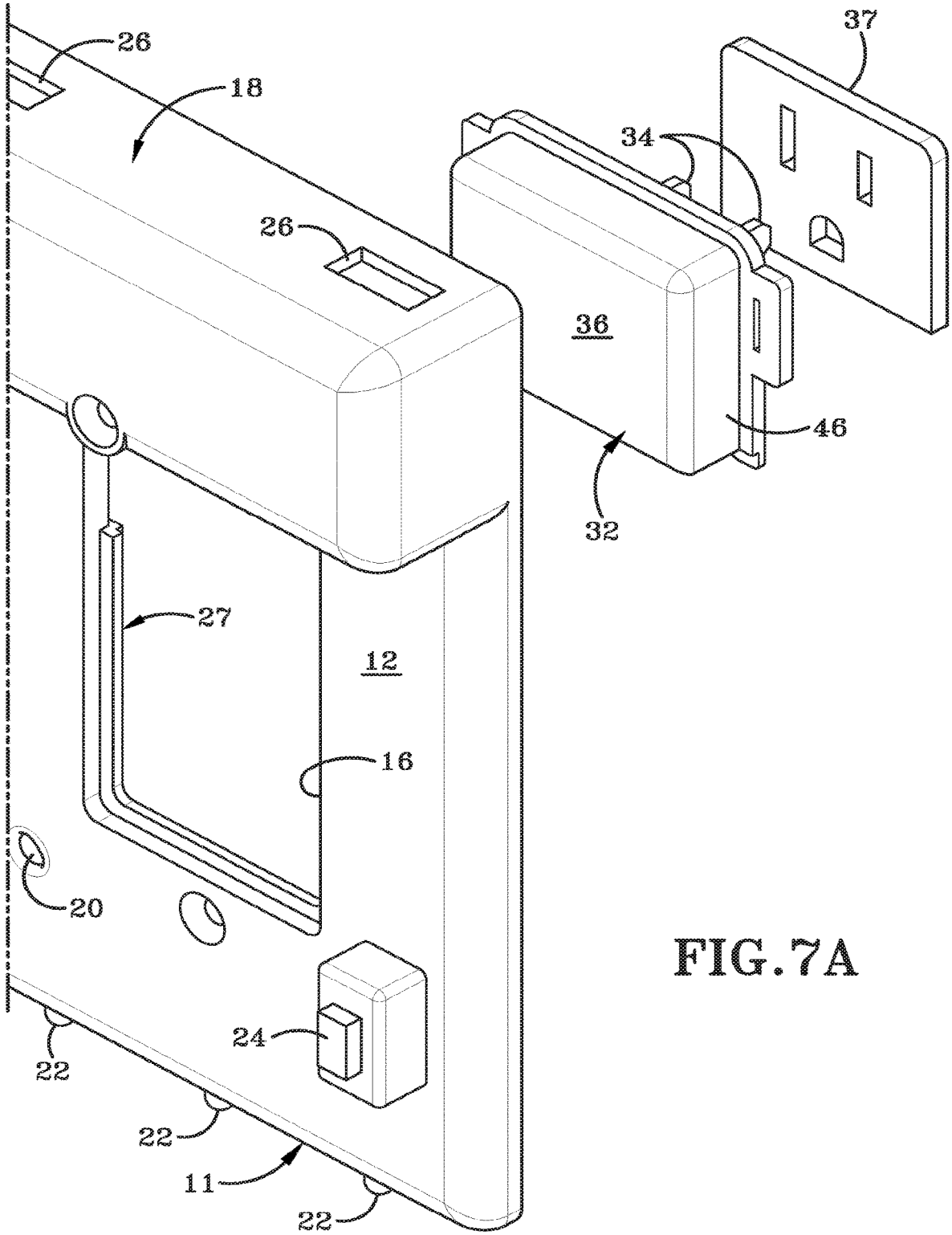
FIG. 7A is a exploded perspective view of the second embodiment powered wall plate.
Figure 8:
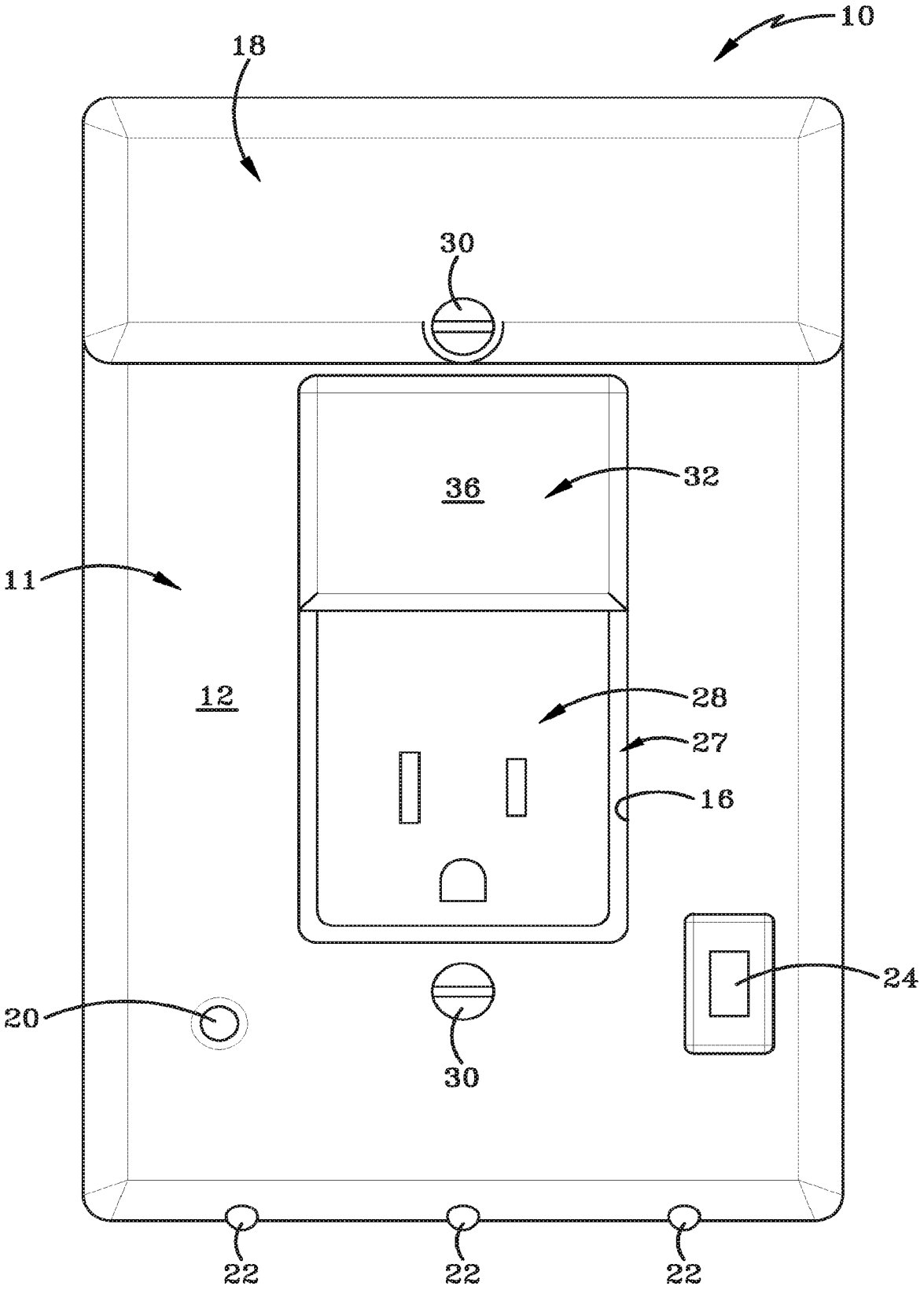
FIG. 8 is a front view of the second embodiment powered wall plate.
Figure 9:
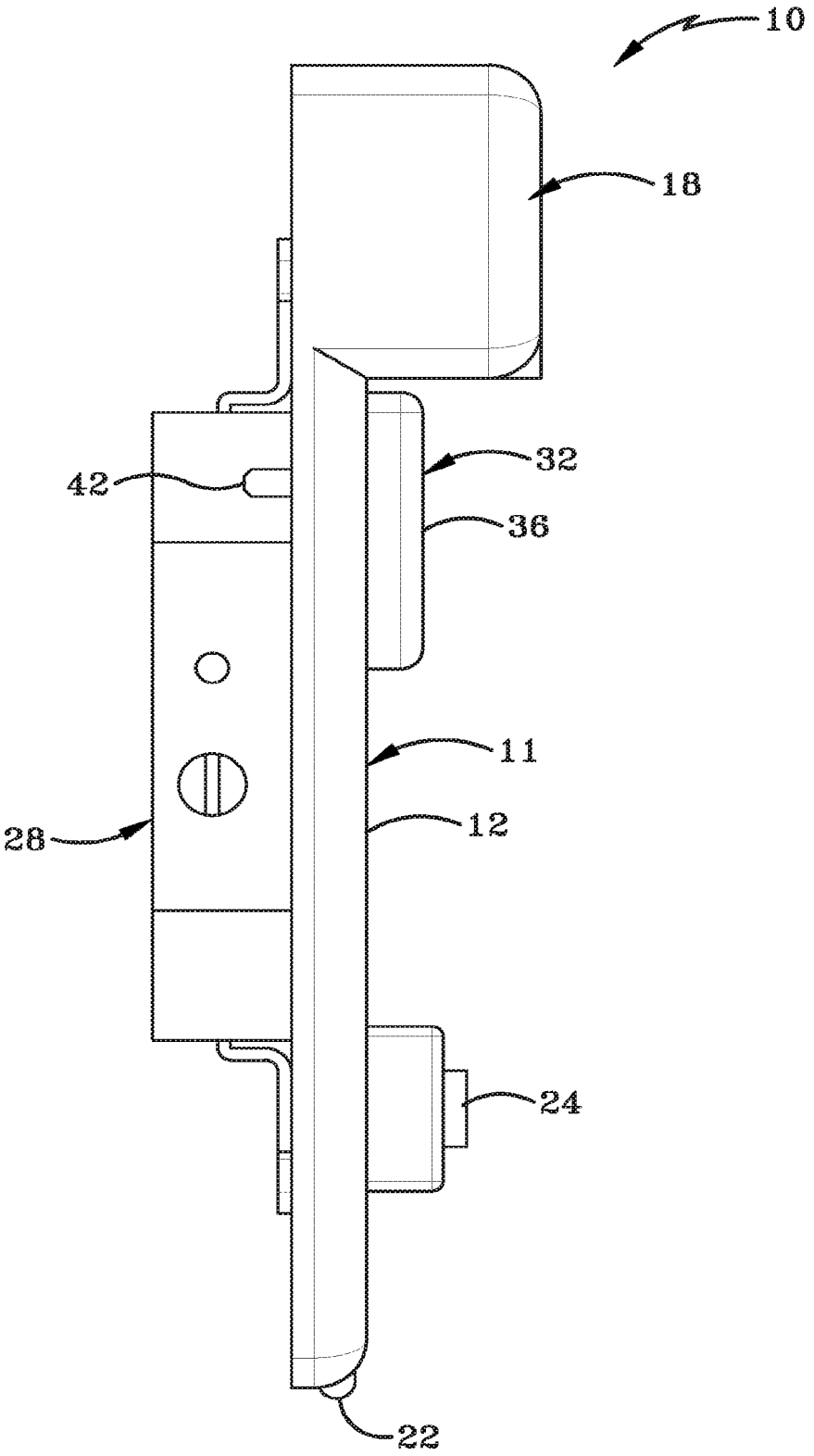
FIG. 9 is a left side view of the second embodiment powered wall plate.
Figure 10:
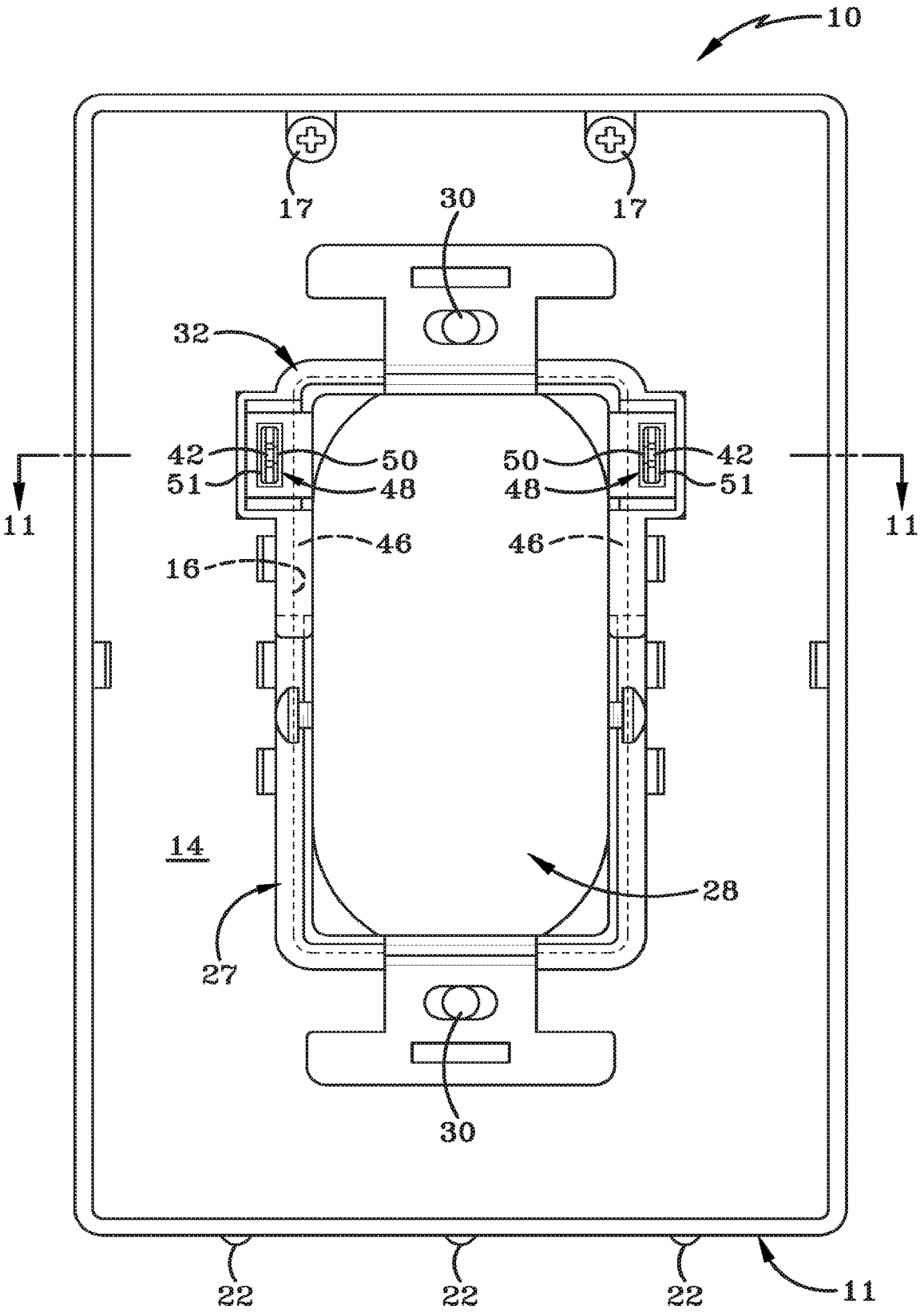
FIG. 10 is a rear view of the second embodiment powered wall plate.
Figure 10A:
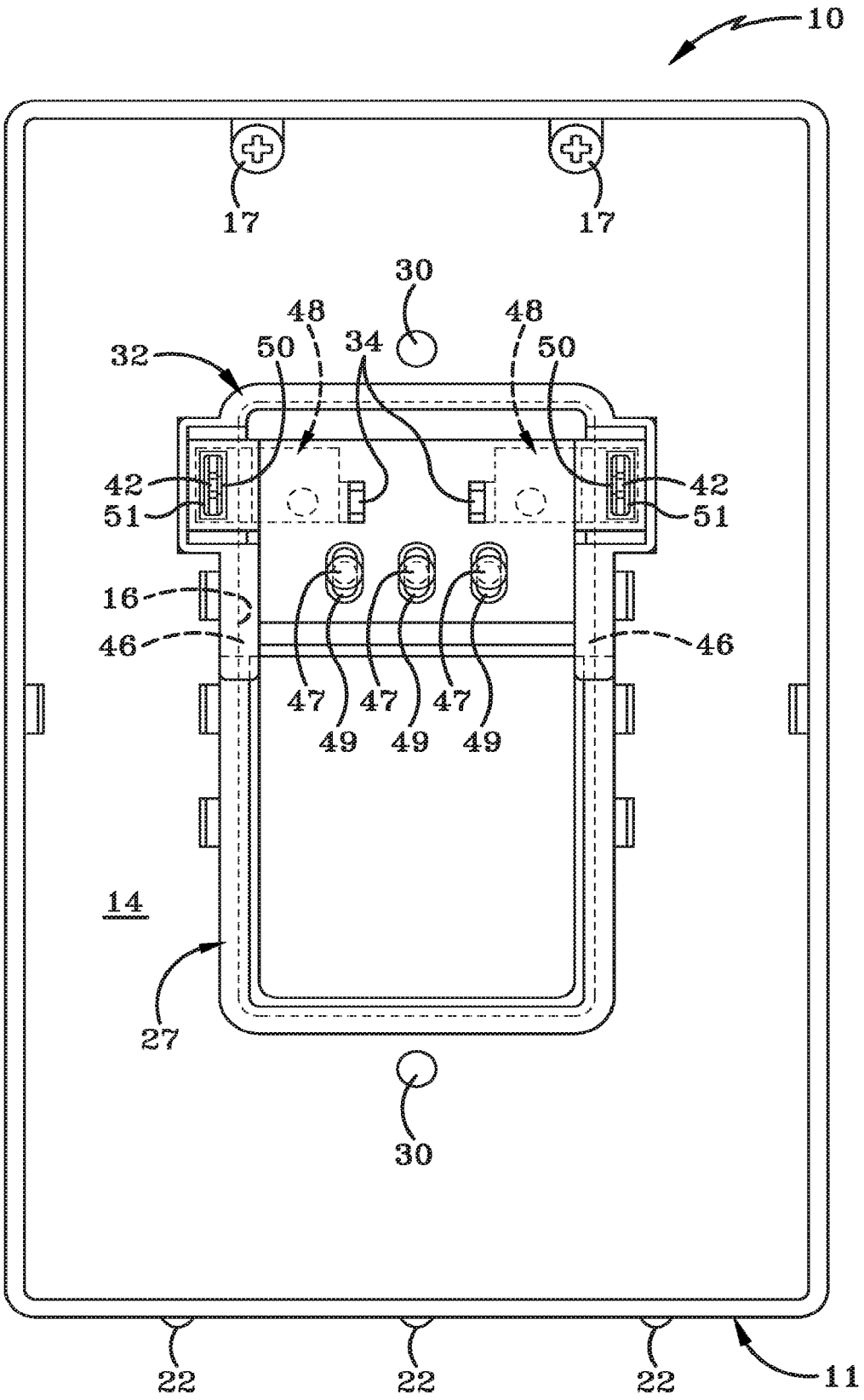
FIG. 10A is a rear view of the second embodiment powered wall plate with the electrical device removed.
Figure 10B:
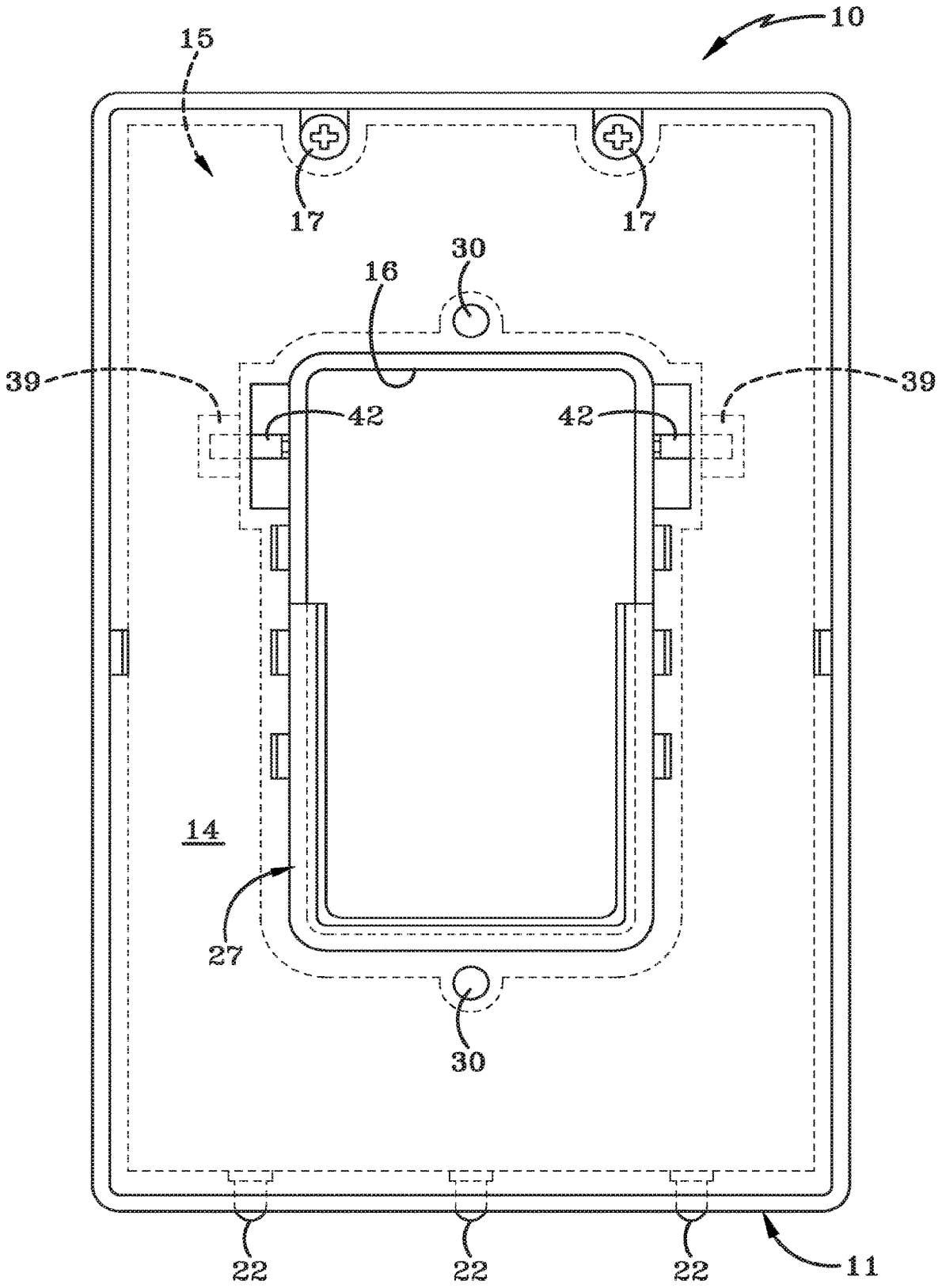
FIG. 10B is a rear view of the second embodiment powered wall plate with the electrical device and the plug-in module removed.
Figure 10E:
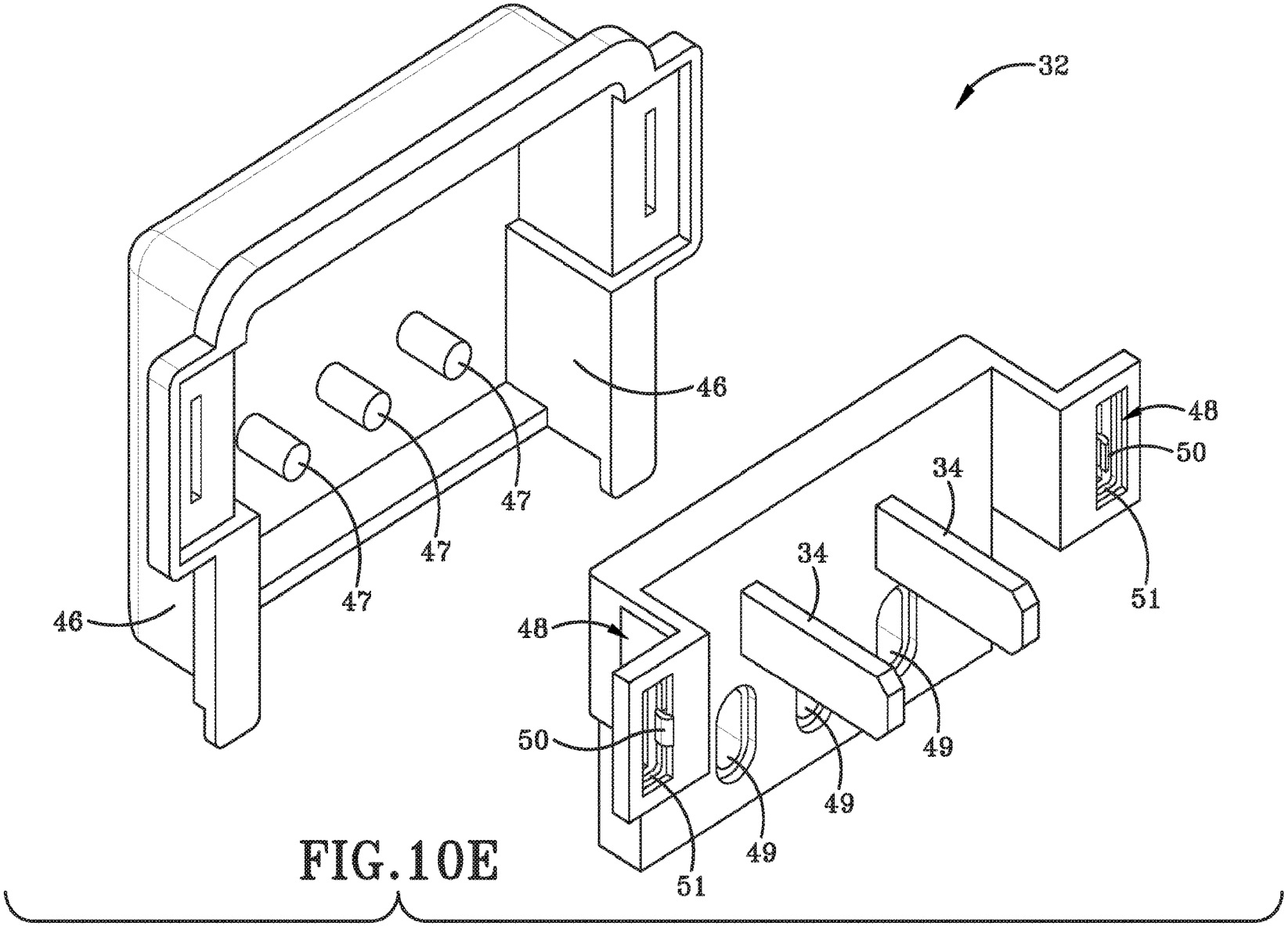
FIG. 10E is a rear exploded view of the plug-in module.

FIGS. 7 though 11A illustrate a second powered wall plate 10 which is structurally similar to the first embodiment powered wall plate described and show in FIGS. 1-6, but utilizes a plug-in module as will be described in more detail below. It is anticipated that the powered wall plate shown in FIGS. 1-11A may be sold with the components that could allow installation of either the hard wire version illustrated in FIGS. 1-6 or the plug-in module version shown more specifically in FIGS. 7-11A without departing from the sprit and scope of the present disclosure.

Wall plate 10 includes a plug-in module 32 having a front surface 36, prongs 34, and arms 46 extending outward from each side. Arms 46 each include a current transfer unit 48 having a current transfer contact 50 therein. Each current transfer contact 50 is operatively connected to prongs 34 to receive electrical current from the electrical device and transfer the electrical current to the circuit board via wall plate interface 39 and wall plate current feature 42 to power the wall plate. Each current transfer unit 48 may include an aperture 51 adapted to receive the wall plate current feature 42 adjacent current transfer contact 50.

Plug-in module 32 may also be oriented to slide plugs 34 upwards or downwards to ensure that the plug-in module can be utilized with any type of electrical device and still transfer electrical current to the wall plate current feature 42. For example, the plug-in module body may include rivets 47 arranged to receive apertures 49 which are elongated and may include a recessed portion. The recessed portion allows the rivets 47 to be compressed at the head and allow the plugs 34 to move upward and downwards relative to the rivets 47 but still be retained to prevent disconnection. This upward or downward relative movement may be important in some circumstances where device dimensions vary. Specifically, the distance between the powered wall plate mounting screw and the upper or lower electrical prong apertures on electrical device 28 may be different for a duplex receptacle, a decorator receptacle, or a GFCI receptacle for example or due to manufacturer styles. With the incorporation of this adjustable feature, the powered wall plate 10 is designed to work regardless of the device style or manufacturer, saving time, energy, and retailer stocking needs.

The plug-in module 32 may also include spring biased shutters 71 which surround plugs 34. Shutters 71 are compressed by the electrical device front face when the wall plate is appropriately positioned or are used to ensure that a user is not electrocuted if a portion of electrical plug 34 would otherwise be visible due to a gap between the wall plate and the electrical device. Operation is simple and the spring is biased to the extended position and compressed as appropriate, thereby prevent direct access to the plugs 34 by a user after installation but still allowing full plug prong insertion if possible. If spring biased shutters 71 are omitted, a spacer 37 may be utilized to restrict access to the prongs 34 and prevent electrocution.

Installation of the powered wall plate with the plug-in module includes positioning the plug-in module 32 on the wall plate current feature 42, then installing the wall plate on the electrical device and potentially sliding the plug-in module prongs 34 upwards or downwards slightly to align with the electrical device. Finally, the powered wall plate 10 is secured to the electrical box or electrical device with screws 30. In an alternative installation, the plug-in module 32 is positioned in the electrical device and the wall plate is then positioned so the wall plate current features 42 fit within aperture 51 of arms 46, thereby connecting the plug-in module 32 and the wall plate 10 to transfer current. Regardless of the order of the steps used to install the powered wall plate, the plug-in module 36 provides a simple and efficient way to power the wall plate without hard wiring and may instead be used as a user selected alternative to hard wiring.

Figure 11:
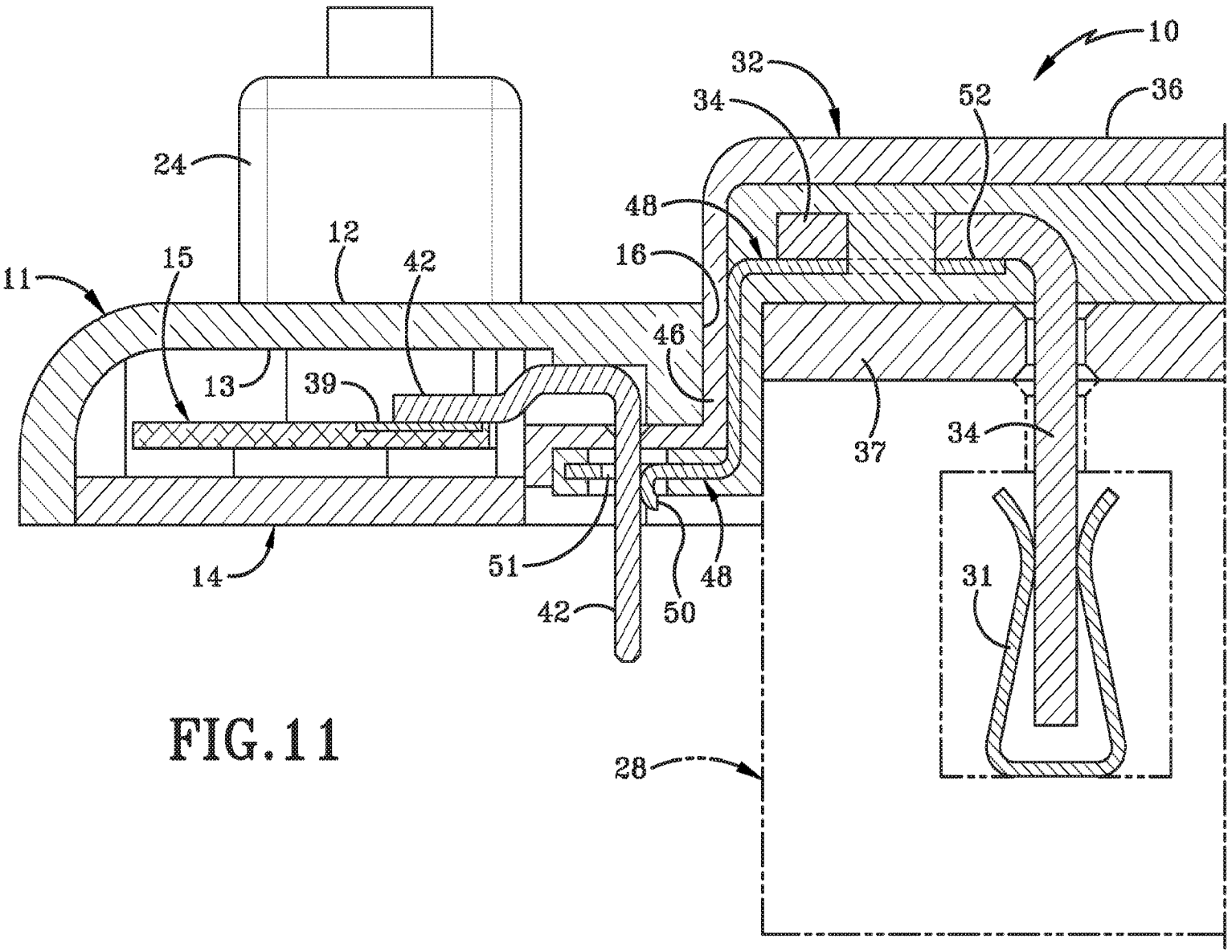
FIG. 11 is a sectional view taken generally about line 11-11 in FIG. 10.
Figure 11A:
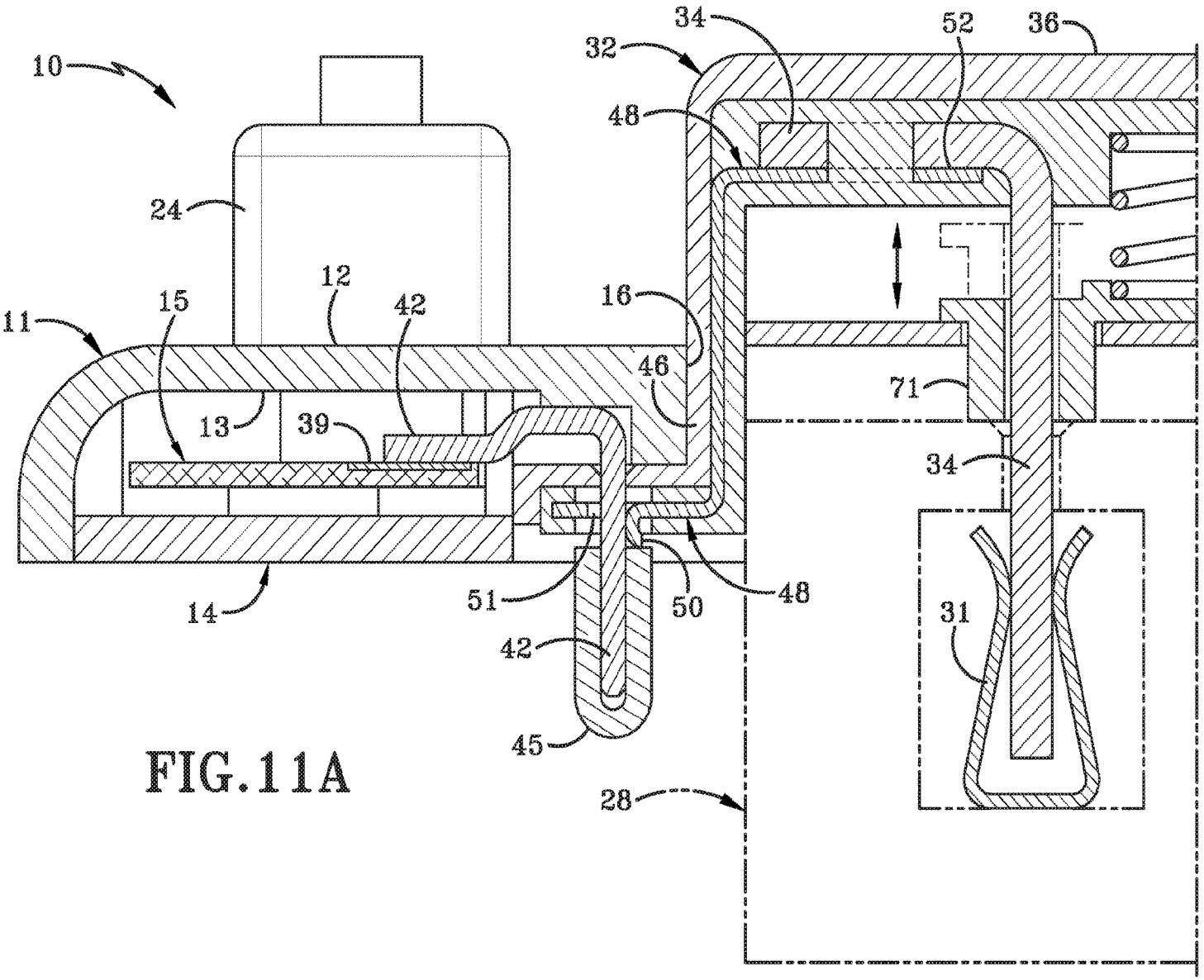
FIG. 11A is a sectional view taken generally about line 11-11 in FIG. 10 and including a cap.

FIG. 11A illustrates another implementation with a cap 45 positioned on the wall plate current feature 42. Thus it is seen that electrical current is easily transferred from the electrical device to the wall plate in a safe and efficient manner.

While FIGS. 7-11A illustrate the plug-in module 32 being positioned on only the upper electrical device openings, it is within the spirit and scope of the present disclosure to position the plug-in module in the lower electrical device openings. A person of skill in the art will appreciate that the powered wall plate will simply need to position wall plate current features 42 consistent with the lower electrical device openings. An alternative implementation would be to include multiple sets of wall plate current features 42 at strategic positions on wall plate 10 and utilize caps 45 where necessary to prevent current transfer or electrocution.

Figure 12:
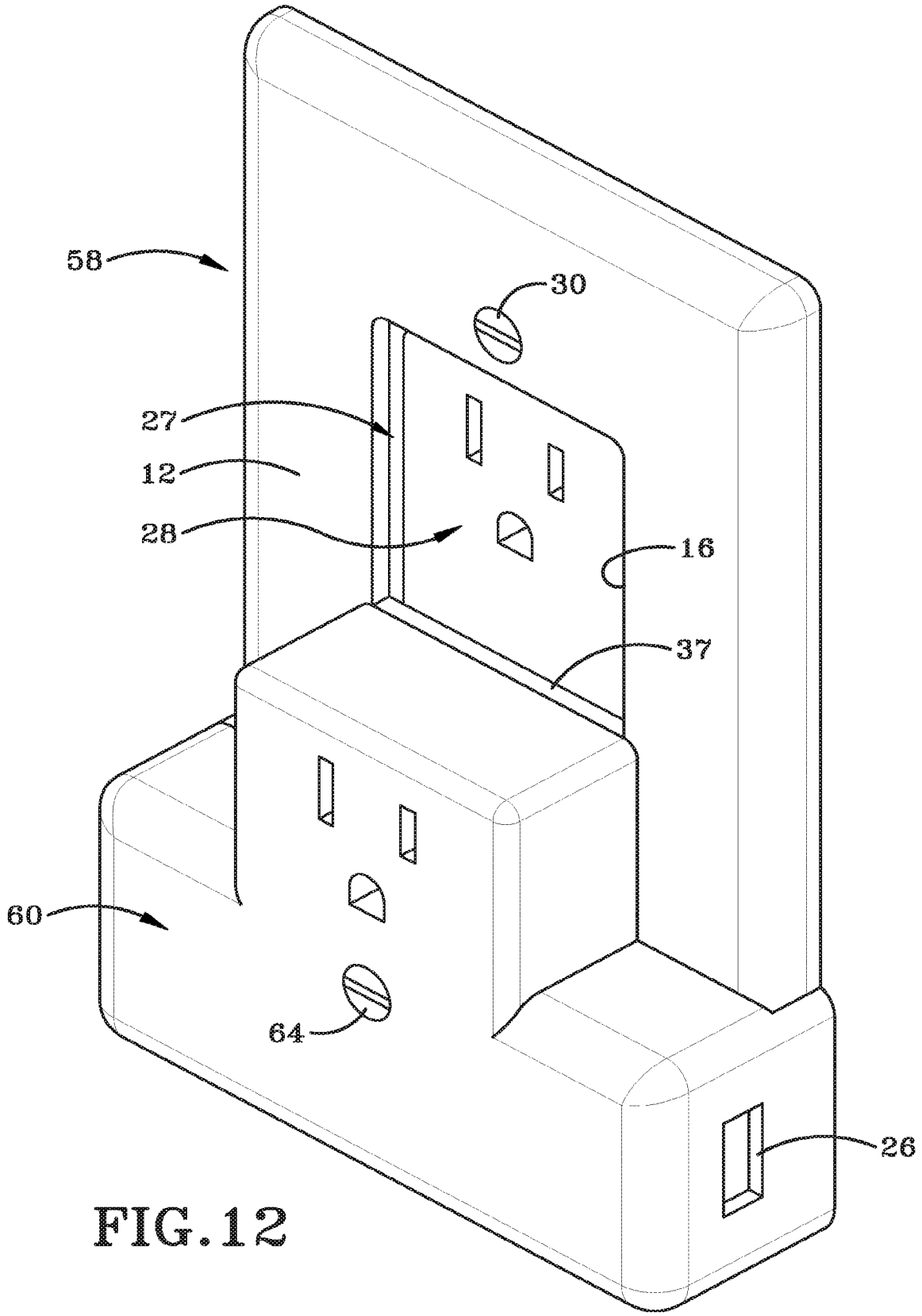
FIG. 12 is a perspective view of a third embodiment powered wall plate.
Figure 13:
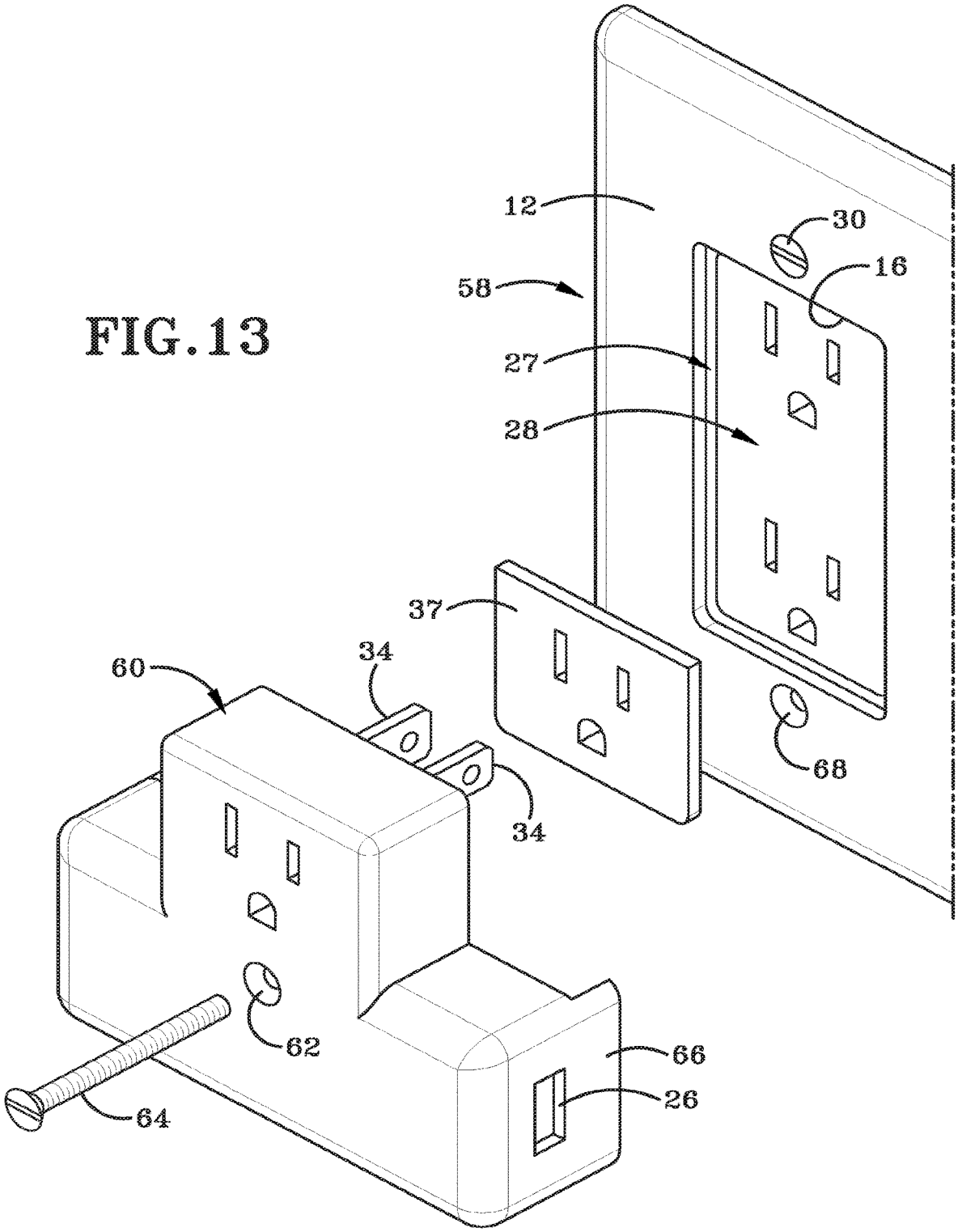
FIG. 13 is an exploded view of the third embodiment powered wall plate.
Figure 14:
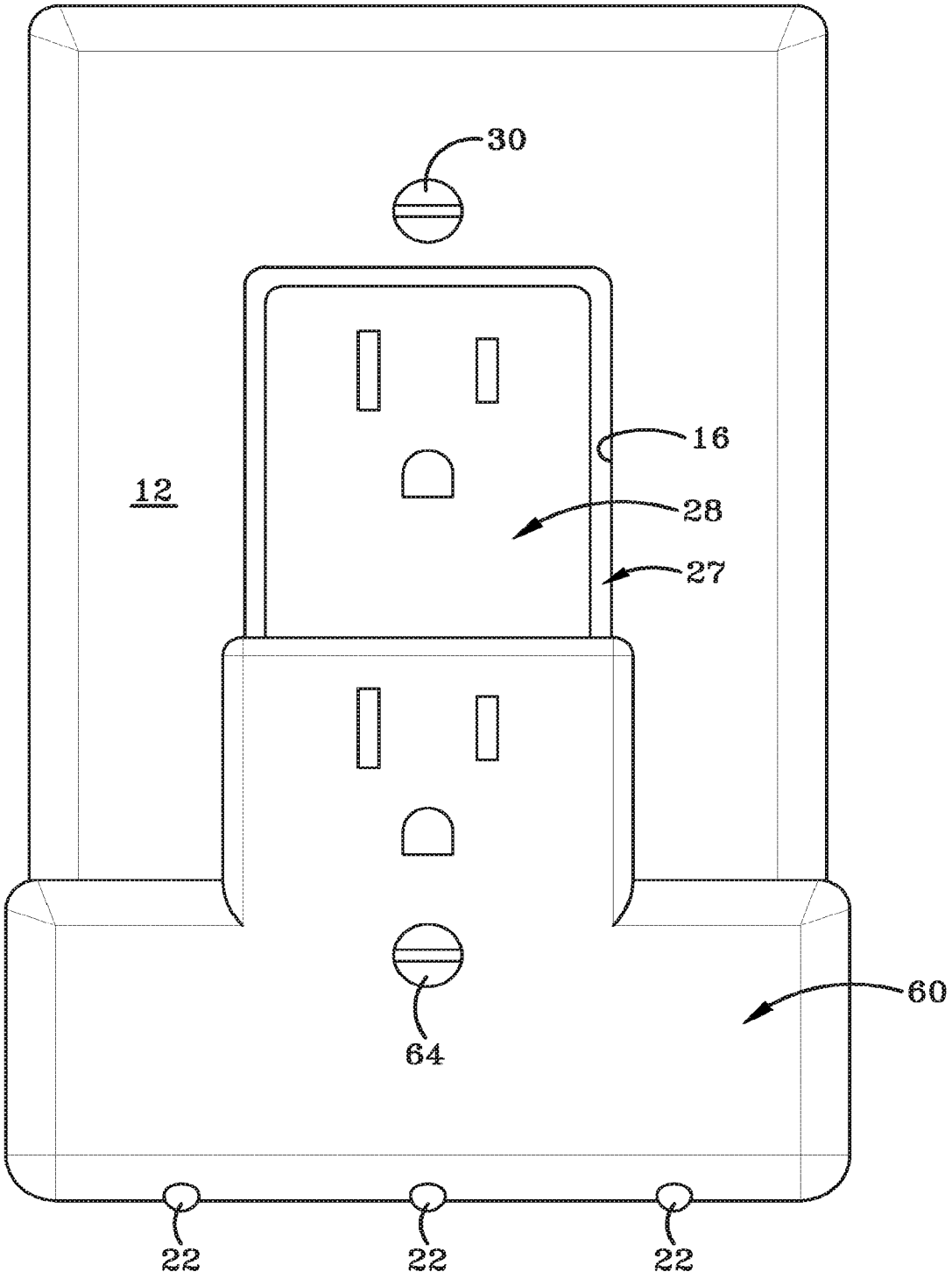
FIG. 14 is a front view of the third embodiment powered wall plate.

FIGS. 12-14 illustrate a third aspect powered wall plate 58 having a body 12 and a plug-in module 60. Plug-in module 60 in this implementation may be larger and include a power transformer, USB ports 26, lights 22, a photosensor, controls, and other features. Advantageously, plug-in module 60 may also include a through hole 62 aligned with a wall plate mounting aperture 68 both arranged to receive a screw 64. In this manner, wall plate body 12 is installed with screw 30, then plug-in module 60 is installed into the electrical device with prong 34 (and spacer 37 if required). Screw 64 is then positioned through holes 62 and 68 to secure the components together with surrounds 66 covering a portion of body 12 to provide an aesthetically pleasing appearance. This way the plug-in module 60 functions like similar illustrations but is easier to install and operate.

Figure 15:
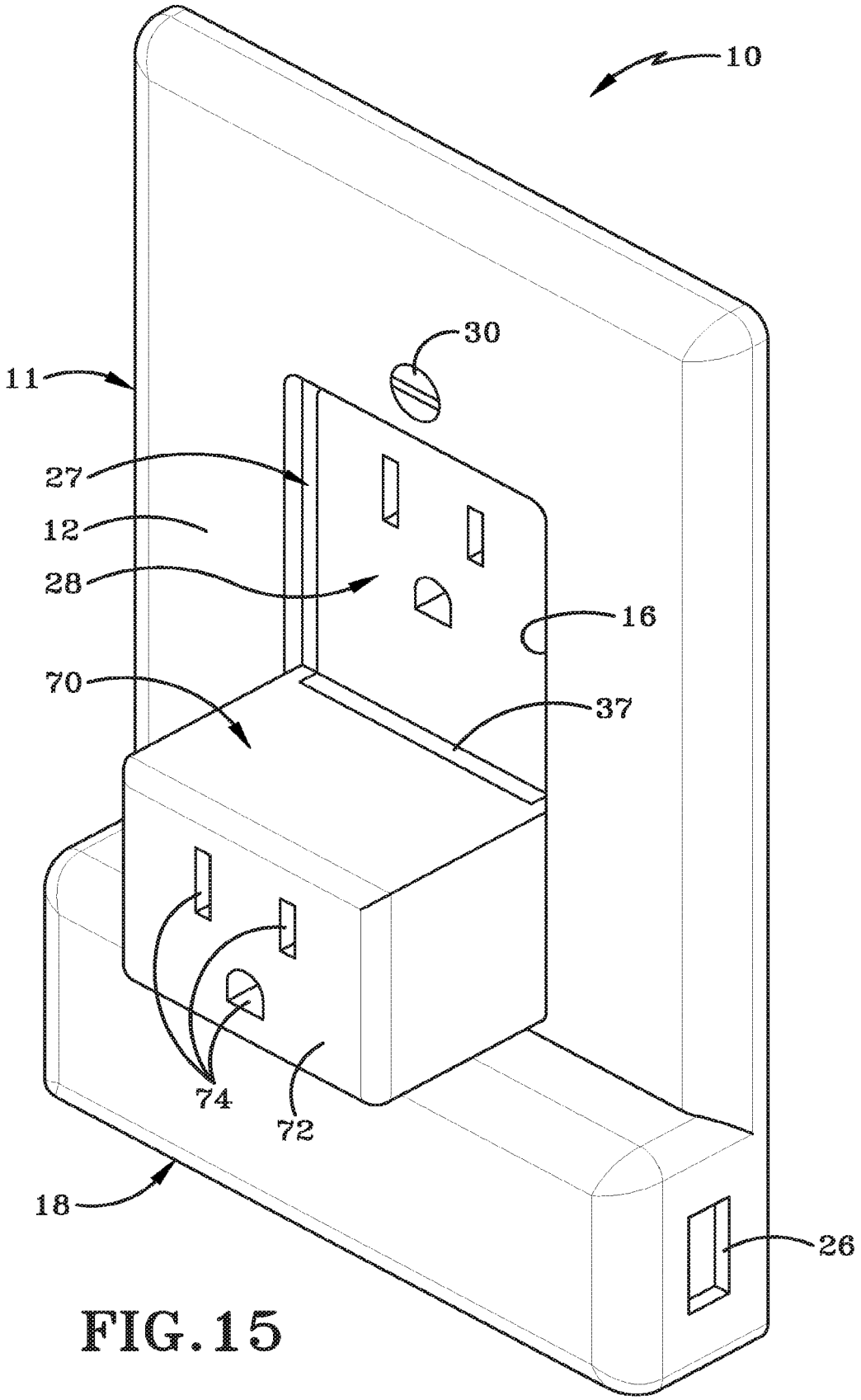
FIG. 15 is a perspective view of a fourth embodiment powered wall plate.
Figure 15A:
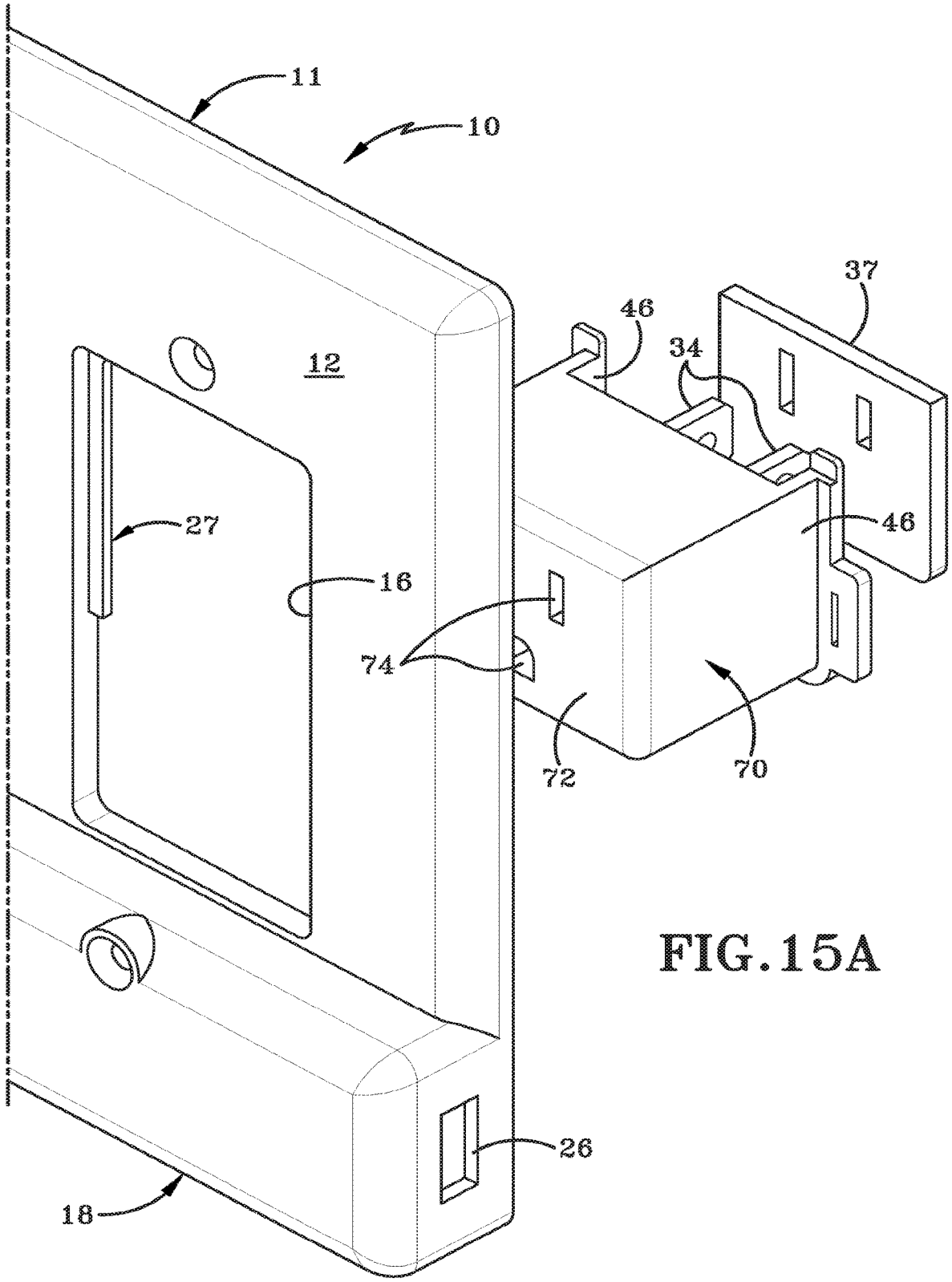
FIG. 15A is an exploded view of the fourth embodiment powered wall plate.
Figure 16:
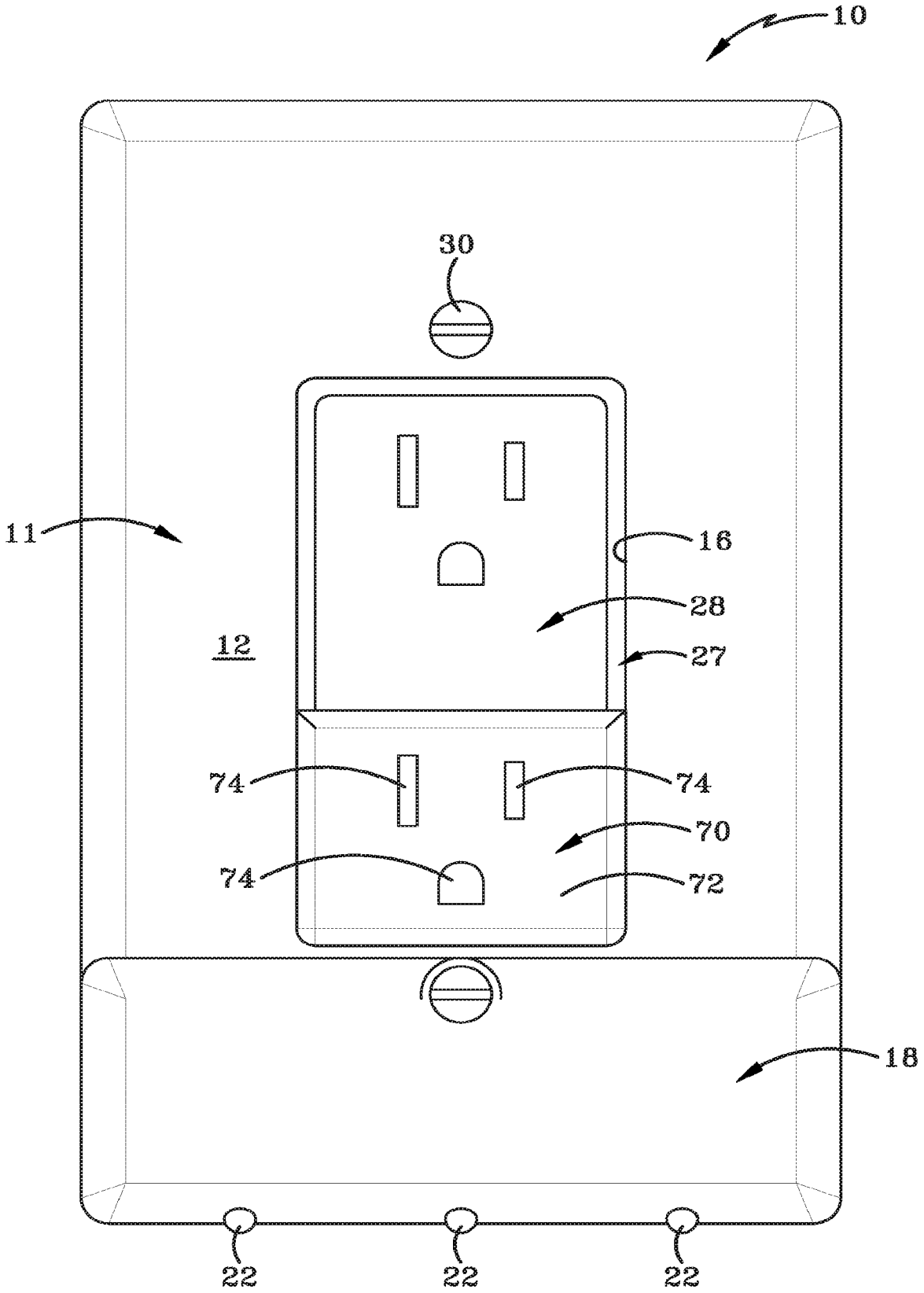
FIG. 16 is a front view of the fourth embodiment powered wall plate.
Figure 17:
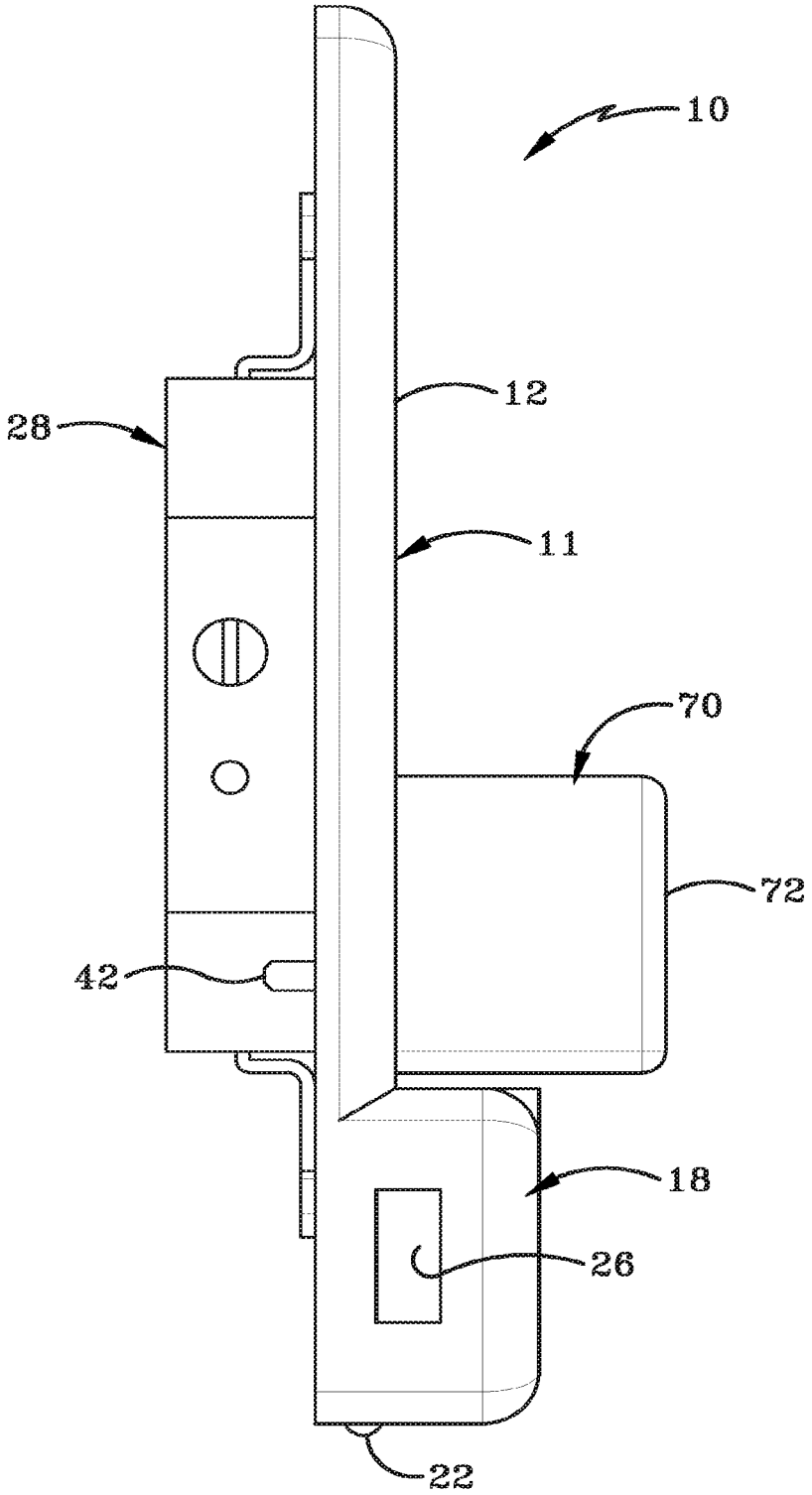
FIG. 17 is a side view of the fourth embodiment powered wall plate.
Figure 18:
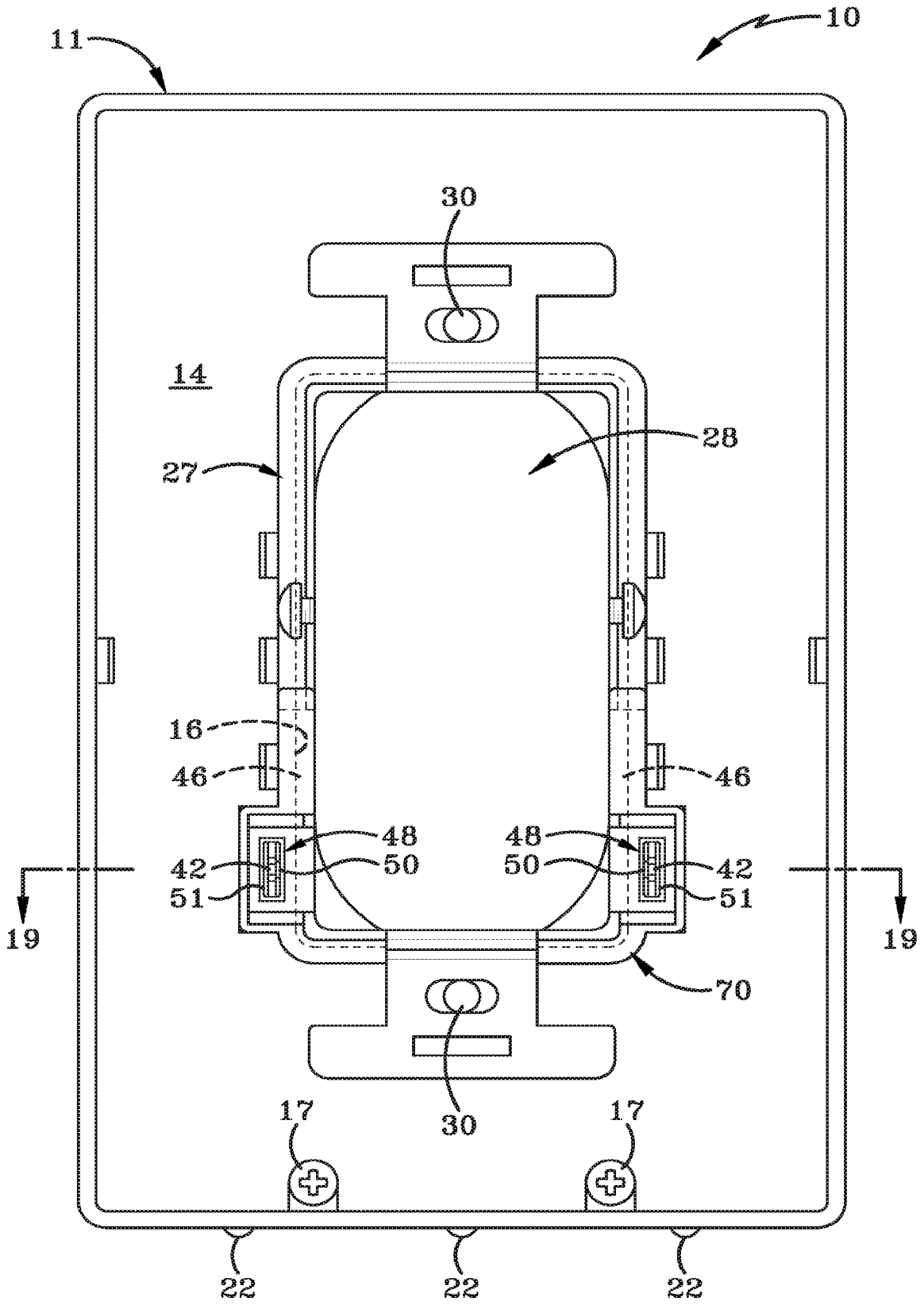
FIG. 18 a rear view of the fourth embodiment powered wall plate.
Figure 18A:
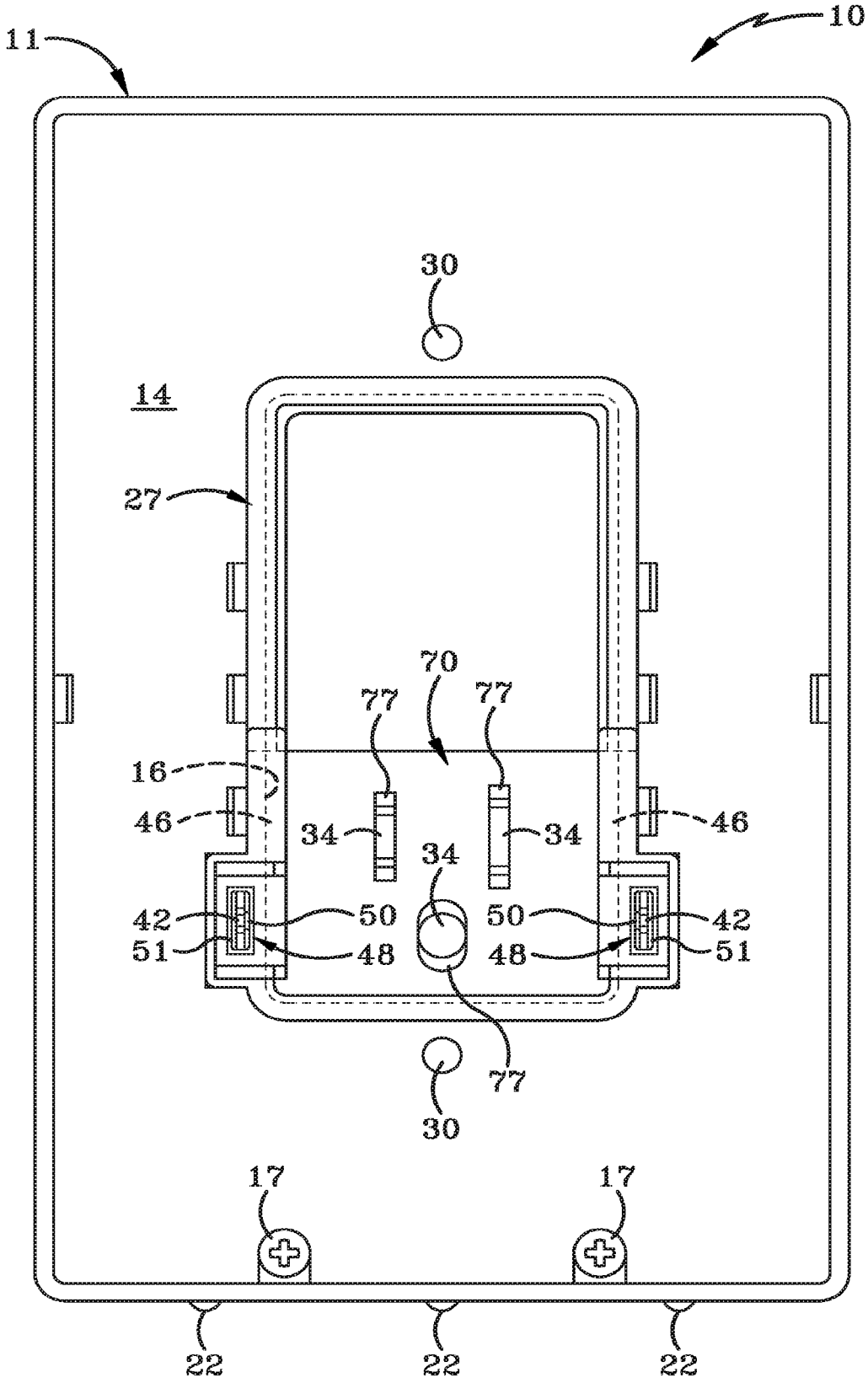
FIG. 18A is a rear view of the fourth embodiment powered wall plate with the electrical device removed.

FIGS. 15-19D illustrate a fourth aspect powered wall plate 10 having a plug-in module 70. As seen in the various views, plug-in module 70 is similar to plug-in module 32 but also includes a front surface 72 having a plurality of apertures 74 therein for receiving an electrical plug therein. In this manner, plug-in module 70 can be positioned within opening 16 of faceplate body 11 and transfer electrical current to powered wall plate 10 similar to previously disclosed embodiments but still provide a plurality of apertures 74 so that the user does not lose access to an electrical outlet. As can also be seen, a spacer 37 may also be utilized to ensure that any gaps which would expose any electrical active components. As further seen in FIG. 15A, adapters 27 may be utilized to fill any potential gaps around the plug-in module 70 and body 11 of powered wall plate 10.

From a functional stand point, the powered wall plate 10 shown in FIGS. 15-19D operates to receive electrical current from the electrical device similar to prior disclosed aspects, such as those shown in FIGS. 7-11A. Similarly, arms 46 each include a current transfer unit 48 having a current transfer contact 50 therein, with each current transfer contact 50 adapted to connect to wall plate current feature 42 to provide electrical current to the powered wall plate 10.

Figure 19:
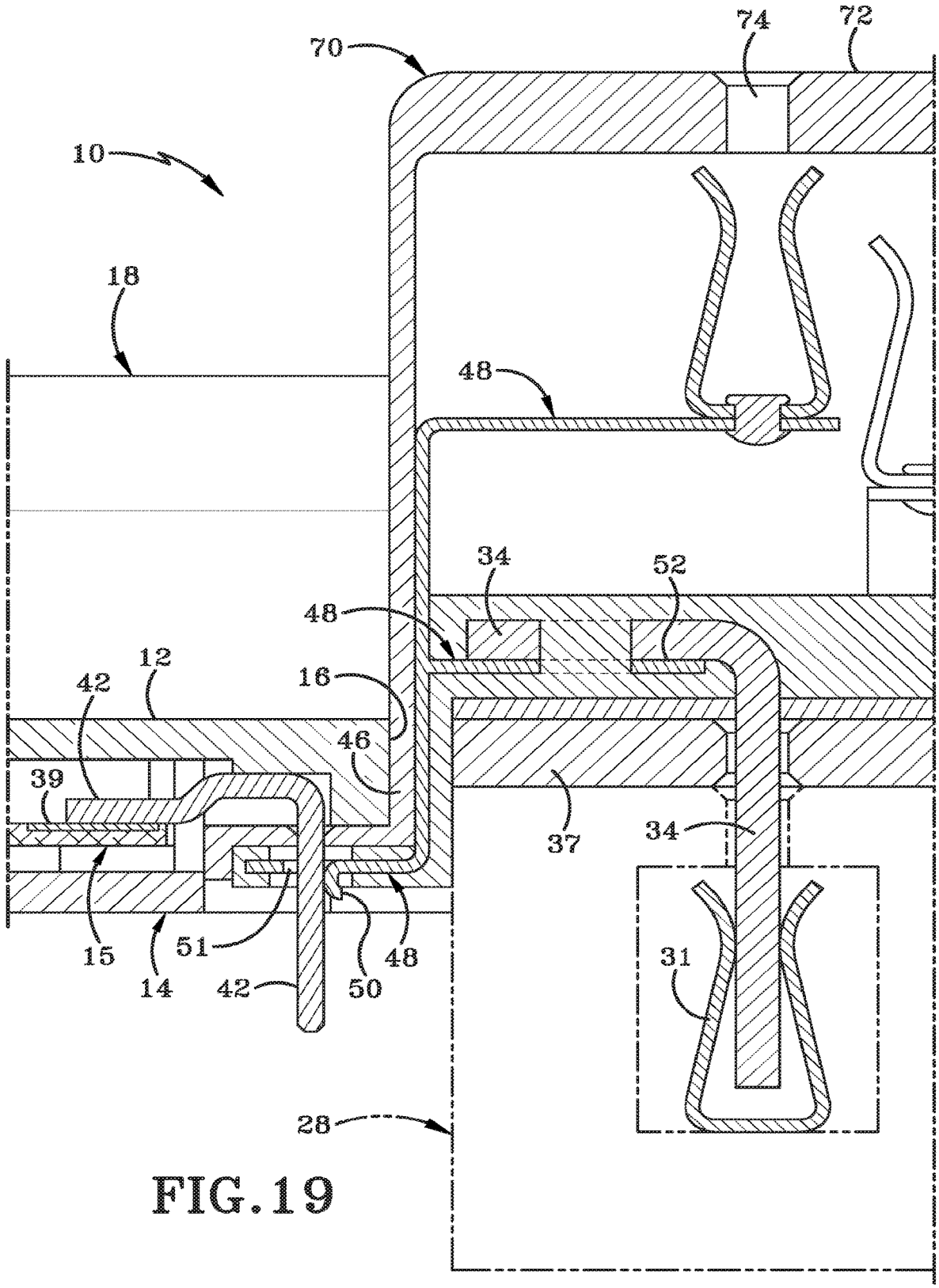
FIG. 19 is a sectional view taken generally about line 19-19 in FIG. 18.
Figure 19A:
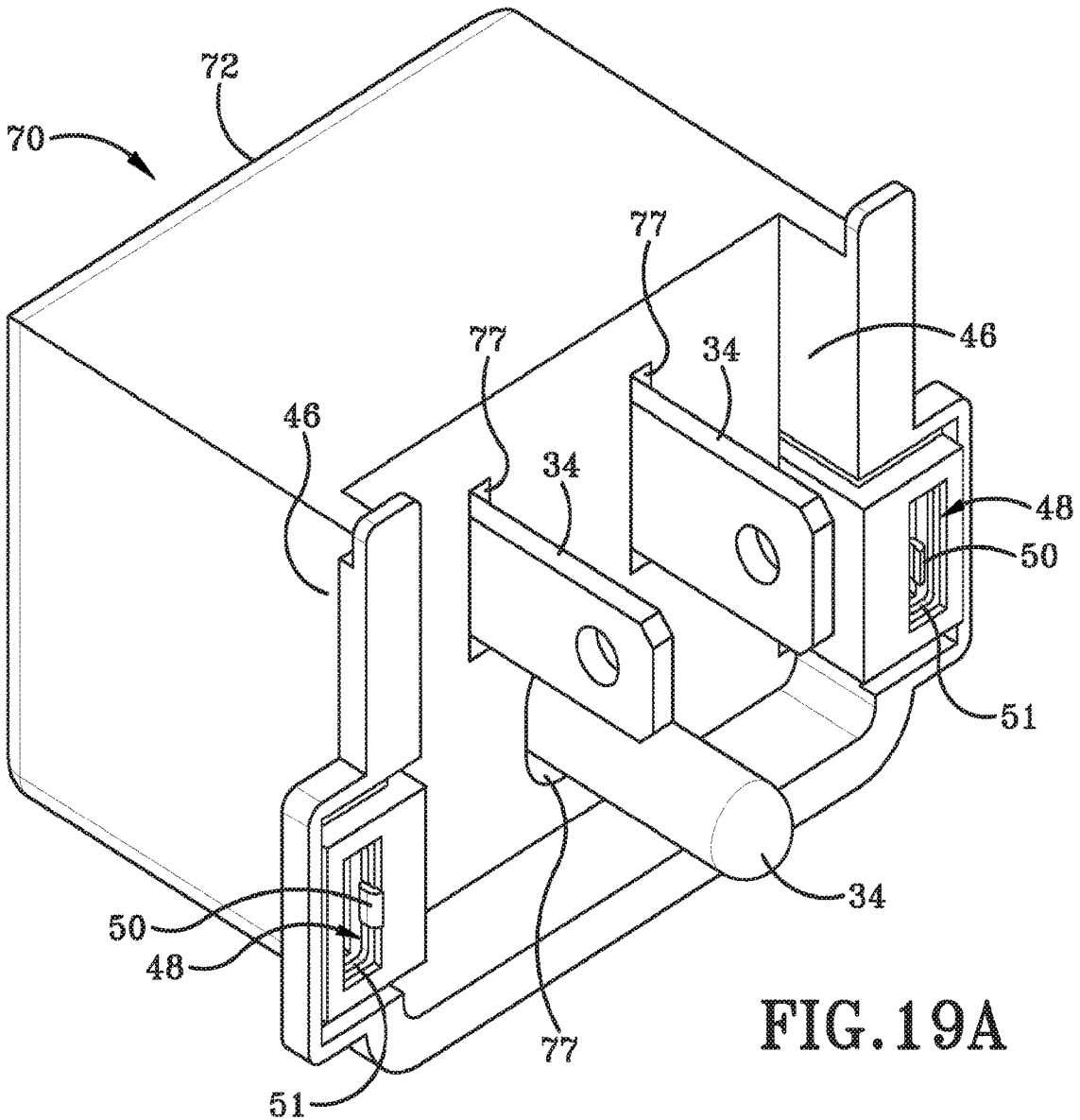
FIG. 19A is a rear perspective view of the plug-in module.

Moving to FIG. 19A, plug-in module electrical prongs 34 are shown extending through apertures which are slightly elongated to allow vertical movement of plug-in module electrical prongs 34 to allow slight adjustments in spacing between the powered wall plate 10 and the electrical device in the electrical box.

Figure 19B:
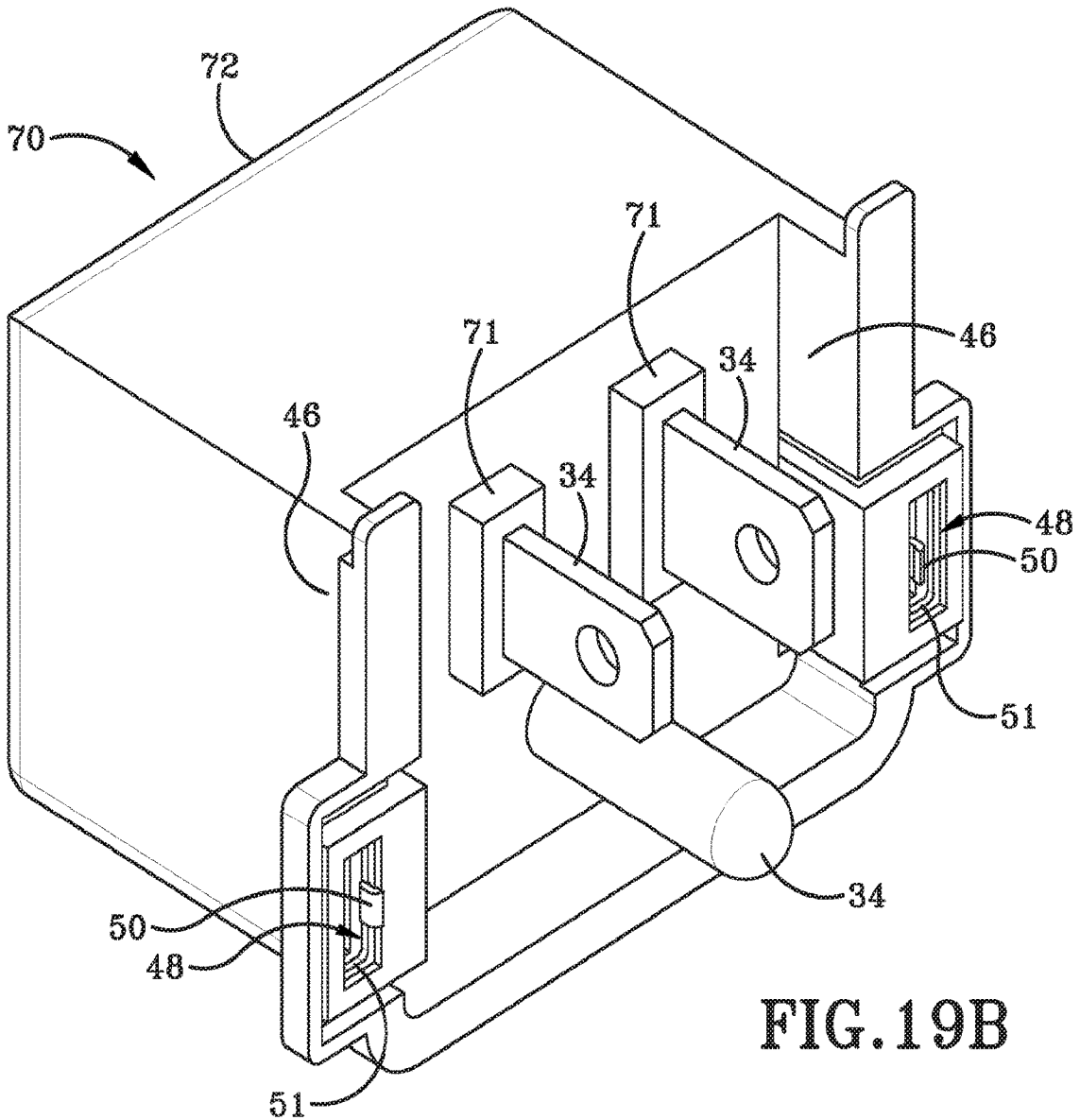
FIG. 19B is a rear perspective view of an alternative plug-in module.

FIG. 19B illustrates a similar plug-in module 70 but illustrates spring biased shutters 71 which function to protect the user from electrocution. Similar to other aspects, spring biased shutters 71 may be compressed by an electrical device face if no protection is needed and may remained extended to protect the plug-in module electrical prong 34 should a small gap otherwise remain.

Figure 19C:
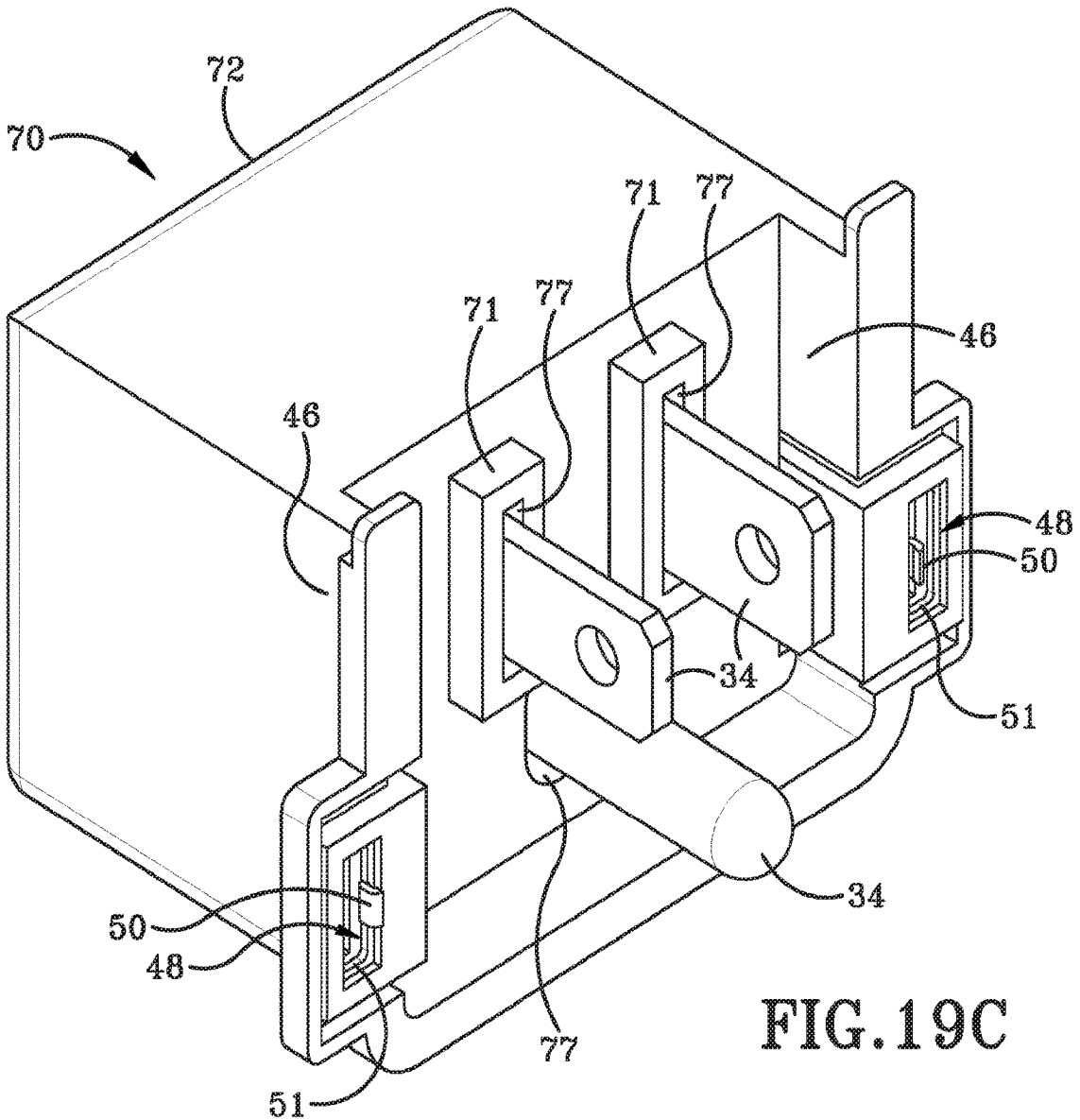
FIG. 19C is a rear perspective view of an alternative plug-in module.

FIG. 19C illustrates a combination of the plug-in module 70 from 19A and 19B. Namely, plug-in module 70 of 19C includes both spring biased shutters 71 and elongated apertures to allow plug-in module electrical prongs 34 to move and allow appropriate adjustment.

Figure 19D:
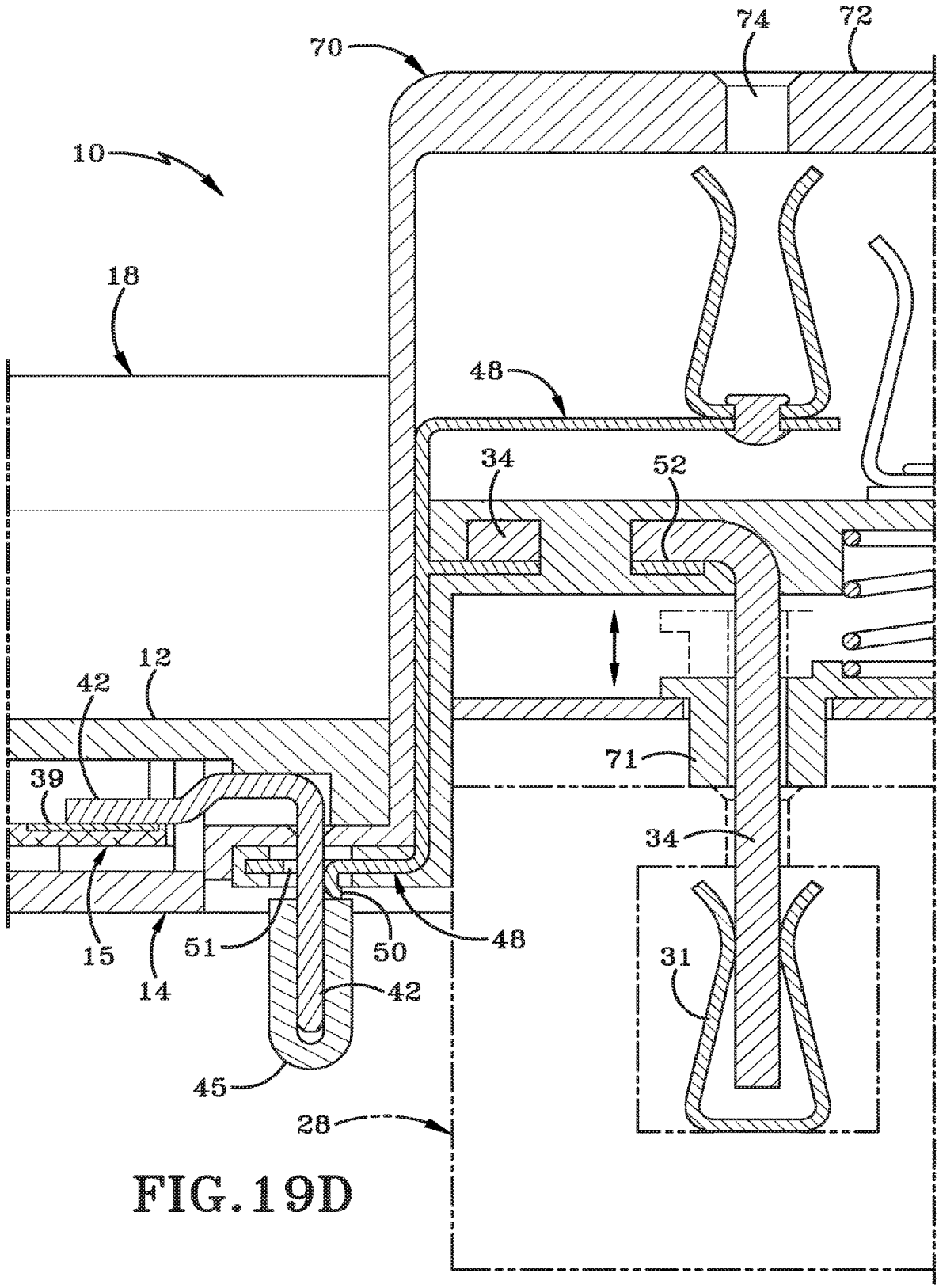
FIG. 19D is a sectional view taken generally about line 19-19 in FIG. 18 and including a cap.

FIG. 19D illustrates plug-in module 70 including a cap 45 similar to previously discussed aspects. Once again, cap 45 functions to prevent and/or restrict potential electrical shock or grounding in case wall plate current feature 42 were to come in contact with another conductive material. Accordingly, it is seen that the various implementations of powered wall plate 10 shown in FIGS. 15-19D may be implemented to power the wall plate while also not reducing the number of available electrical apertures.

Figure 20:
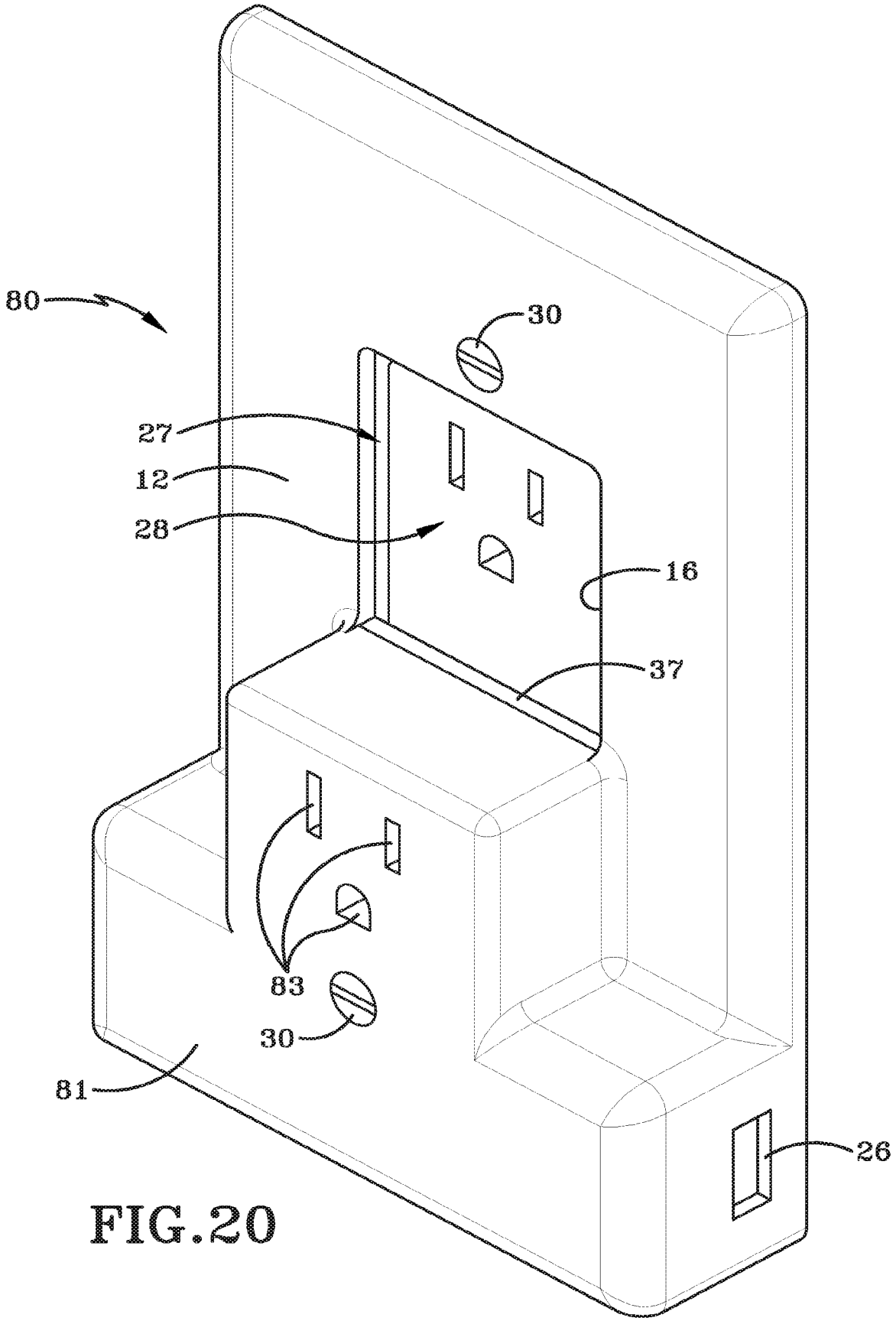
FIG. 20 is a perspective view of a fifth embodiment powered wall plate.
Figure 21:
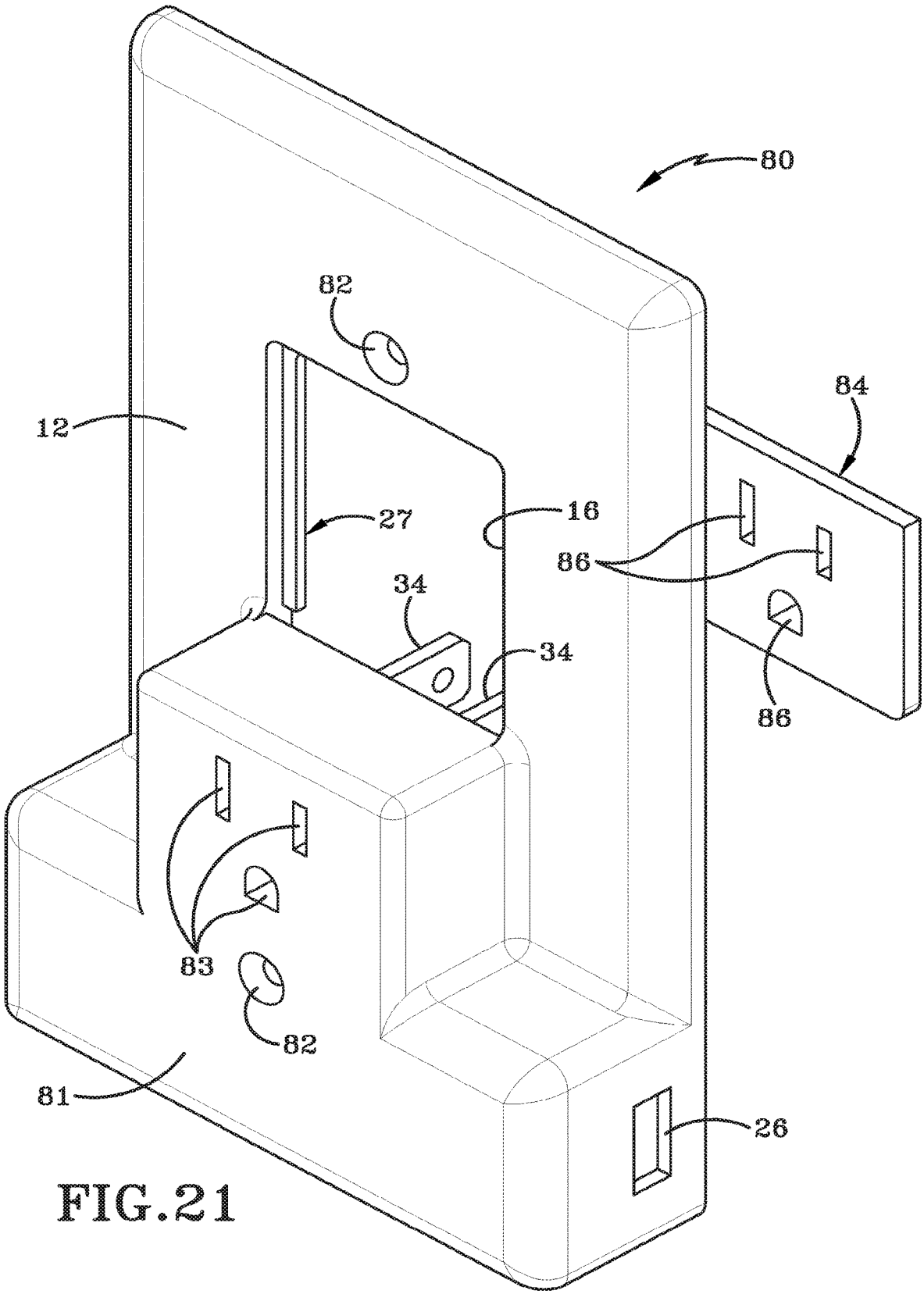
FIG. 21 is an exploded perspective view of the fifth embodiment powered wall plate.
Figure 22:
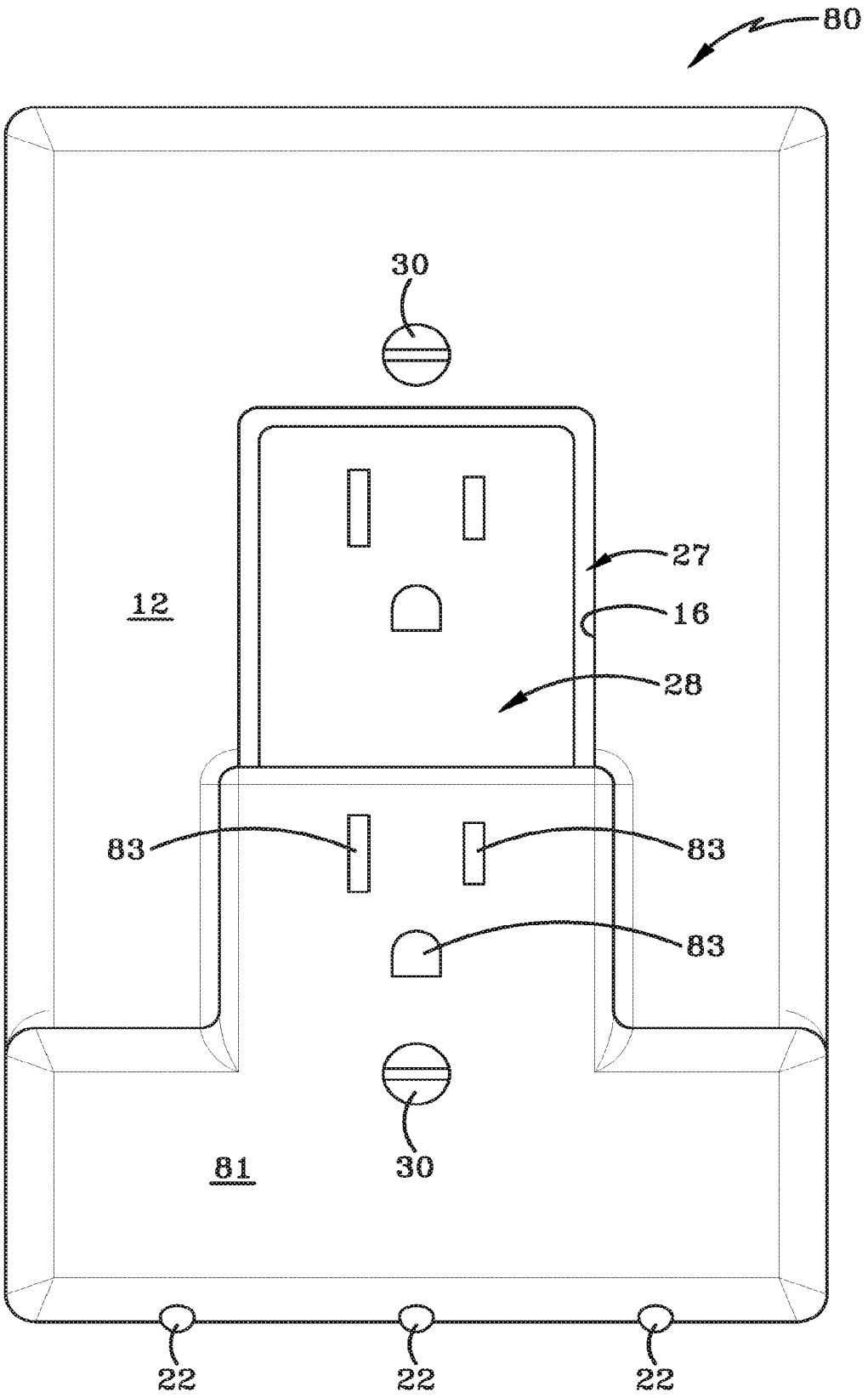
FIG. 22 is a front view of the fifth embodiment powered wall plate.

FIGS. 20-22 illustrate a fifth aspect powered wall plate 80 having a unitary construction. Specifically, powered wall plate 80 includes similar mounting screws 30 but also includes mounting apertures 82 and current apertures 83 on a front face 81. Front face 81 may protrude from the wall plate so that electrical contacts may be positioned therein and aligned with current apertures 83. In this manner, the entire wall plate 80 may be installed with prongs 34 within the electrical device 28 and secured using mounting screws 30 while leaving the upper electrical apertures open and providing additional electrical apertures on front face 81. Accordingly, the powered wall plate 80 can be easily installed with minimal effort.

Figure 23:
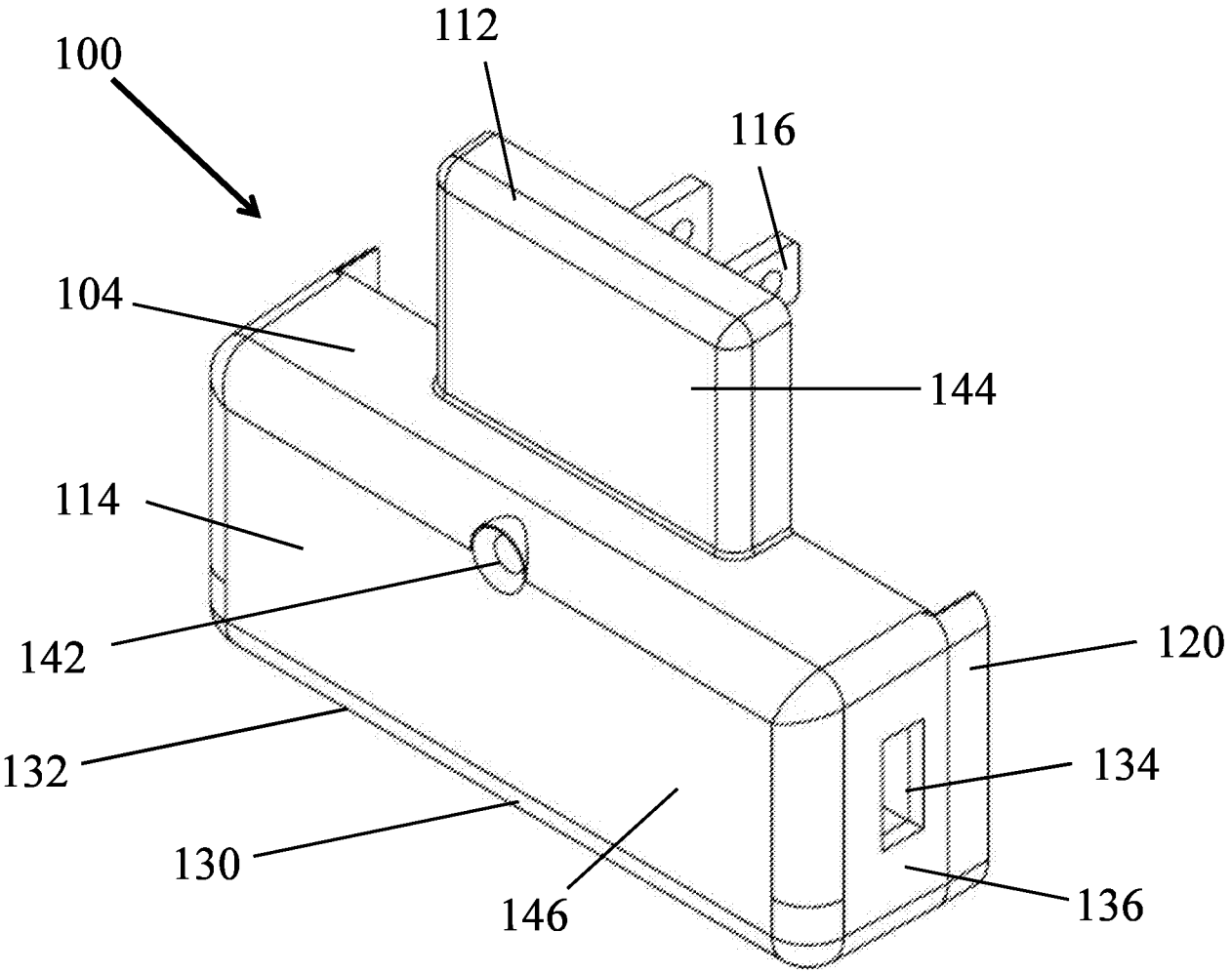
FIG. 23 is a front perspective view of a plug-in module of the powered wall plate.
Figure 24:
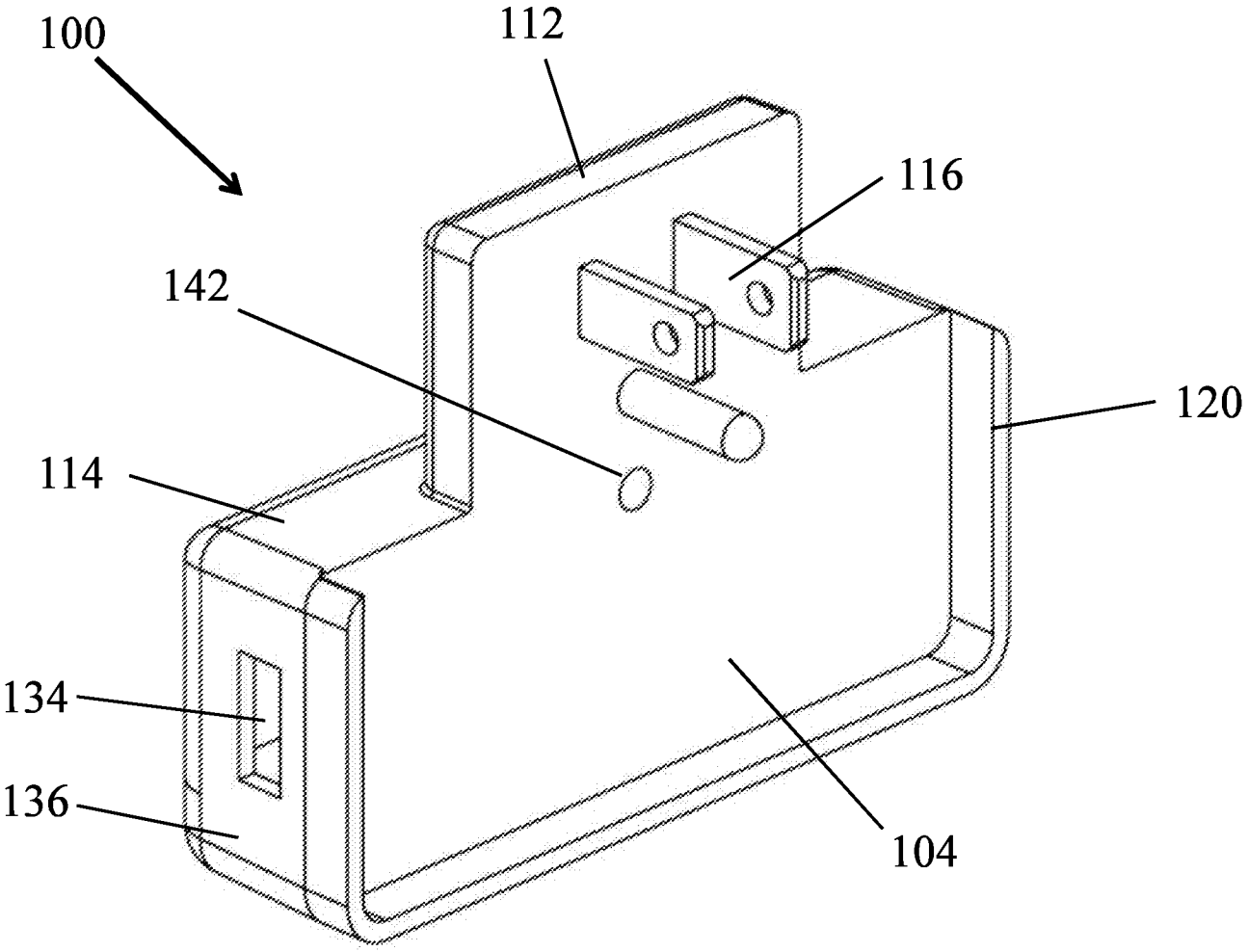
FIG. 24 is a rear perspective view of the plug-in module of FIG. 23.
Figure 25:
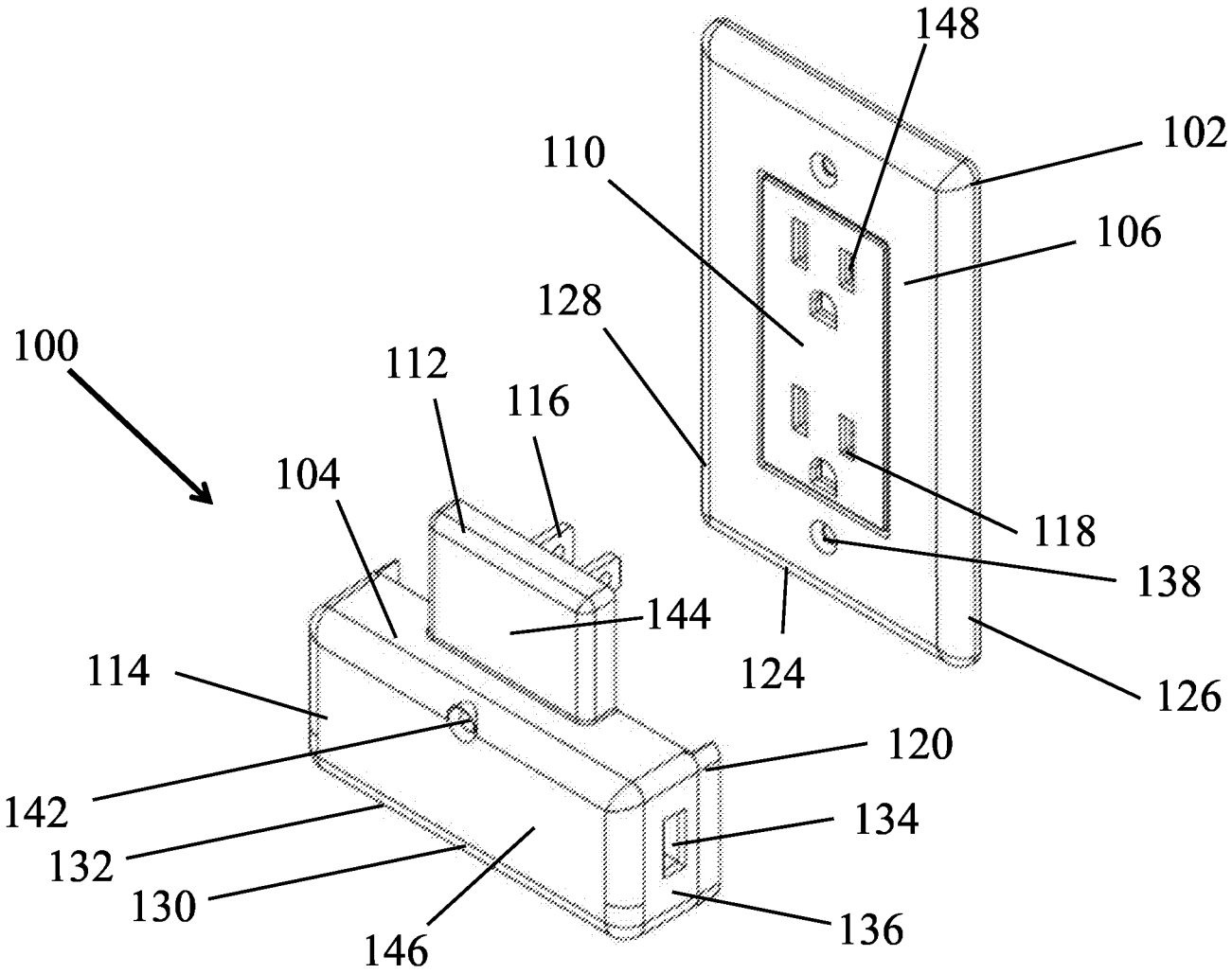
FIG. 25 is an exploded view of the plug-in module of FIG. 23 with a wall plate and electrical device.
Figure 26:
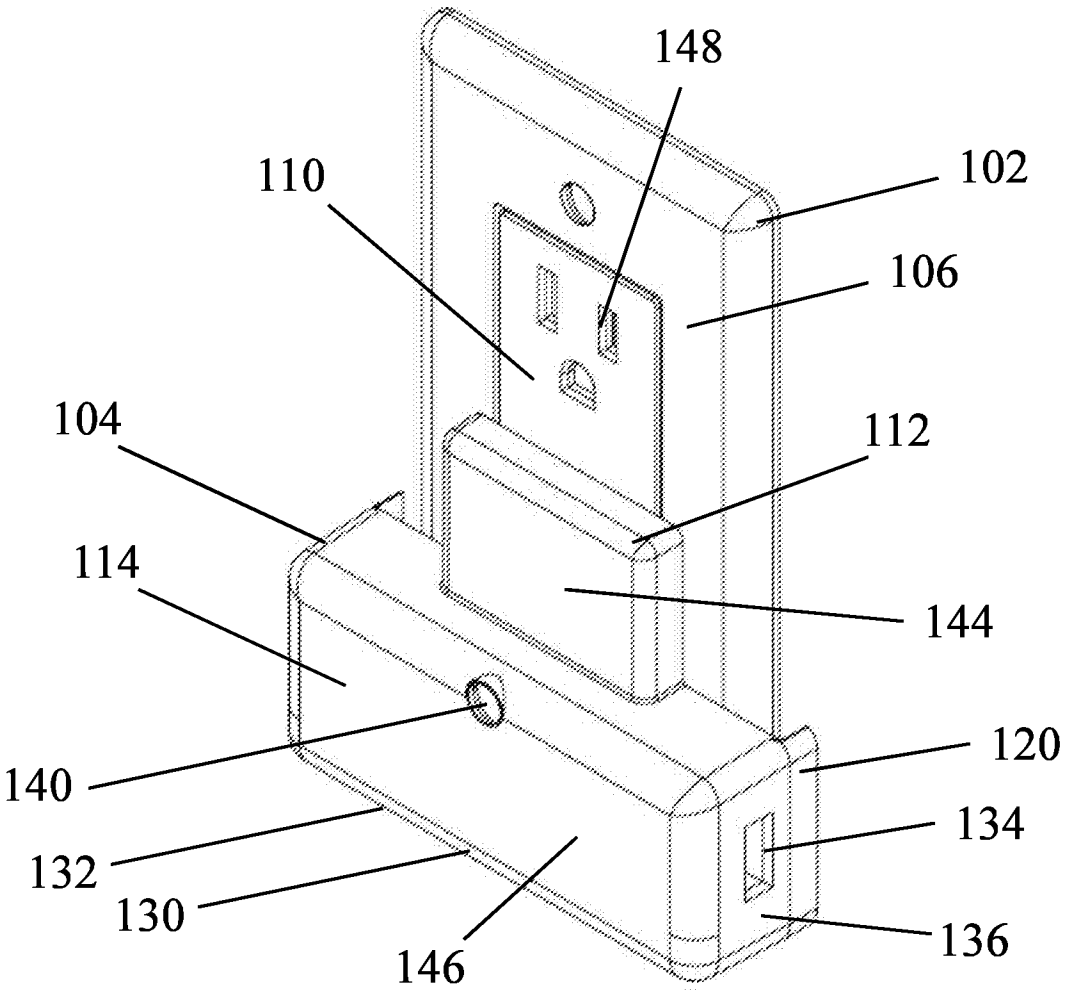
FIG. 26 is a perspective view of the plug-in module of FIG. 23 assembled with a wall plate and electrical device.

FIGS. 23-31 illustrate a sixth embodiment, a powered wall plate 100. As shown in FIG. 23, the powered wall plate 100 has a plug-in module 104. The plug-in module 104 may be configured to couple to a wall plate 102. The wall plate 102 has a front surface 106 opposite a rear surface 108 and an opening 109 extending through the front surface 106 and the rear surface 108 that is large enough to expose an electrical device 110 therethrough (see FIGS. 25-26). The plug-in module 104 may extend forward from the front surface 106 and has an electrical plug 112 and an module cover 114. As illustrated in FIG. 25, the electrical plug 112 has at least two electrical prongs 116 that extend away from the electrical plug 112 toward the electrical device 110. The electrical prongs 116 are configured to removably mate with an electrical receptacle 118 of the electrical device 110.

Figure 27A:
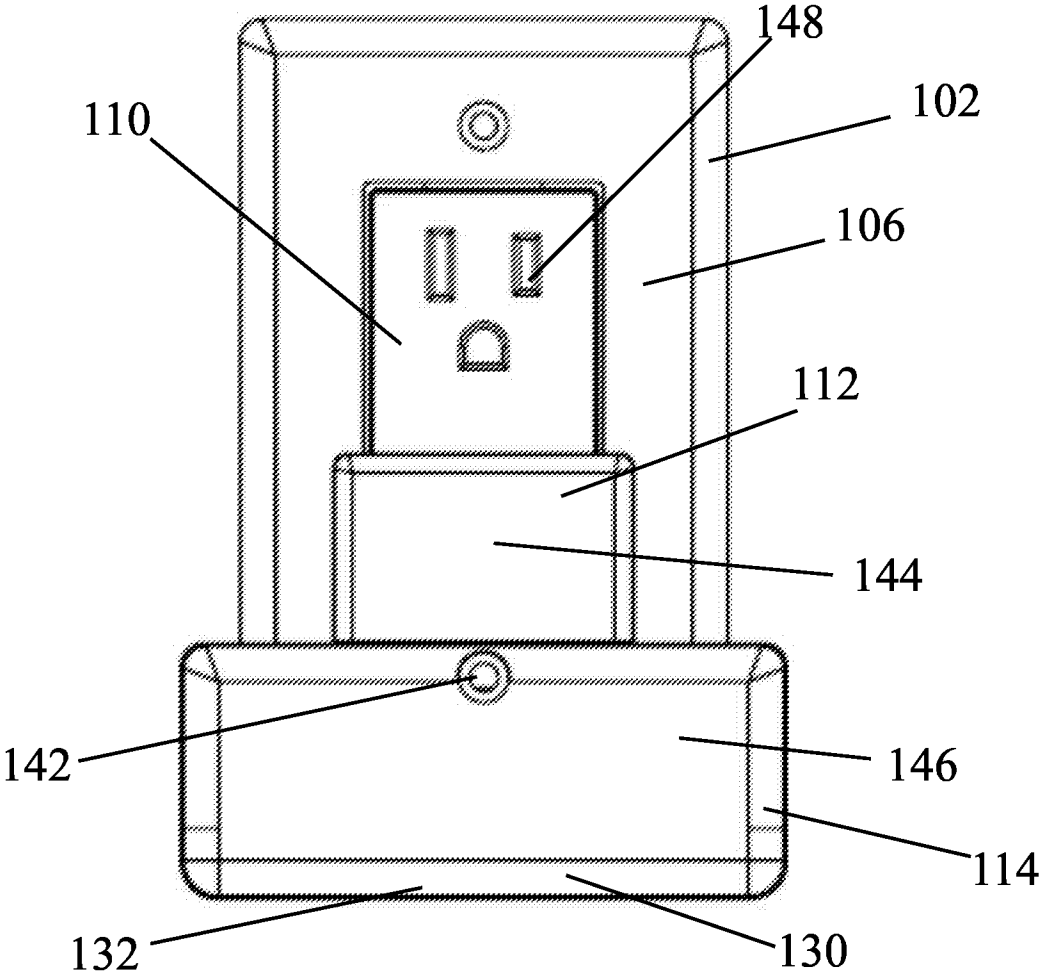
FIG. 27A is a front view of the assembly of FIG. 26.
Figure 27B:
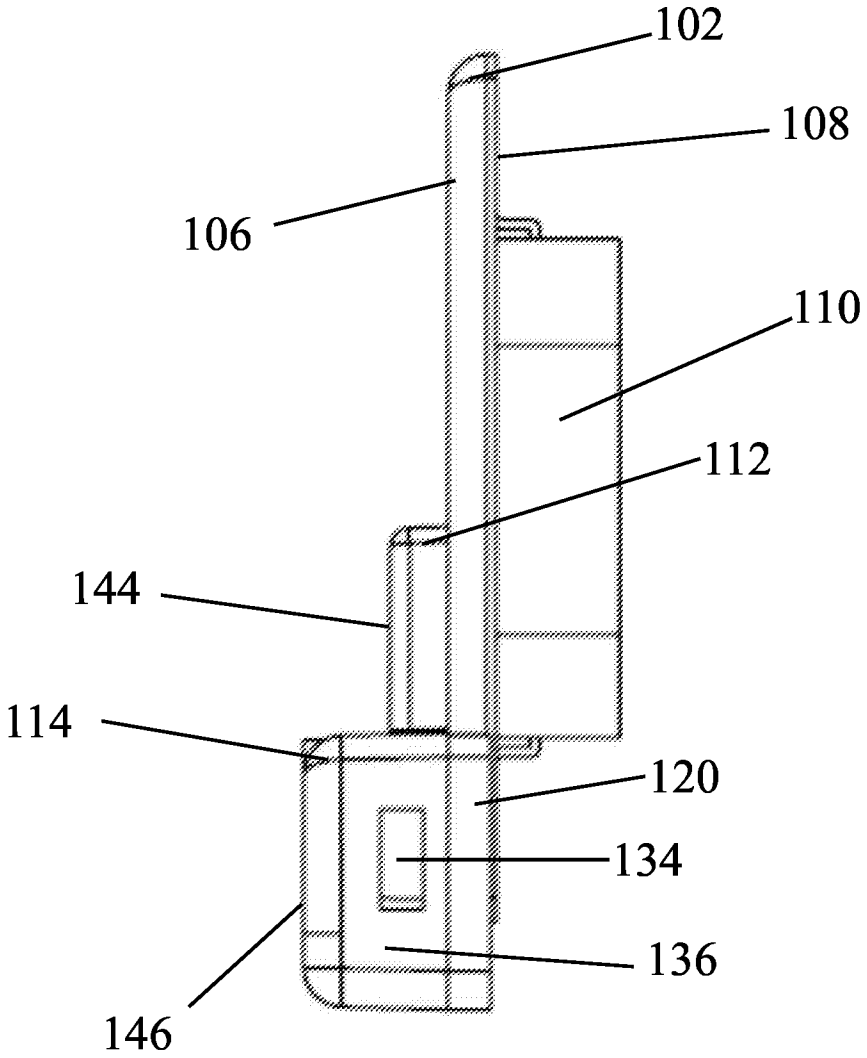
FIG. 27B is a side view of the assembly of FIG. 26.
Figure 28:
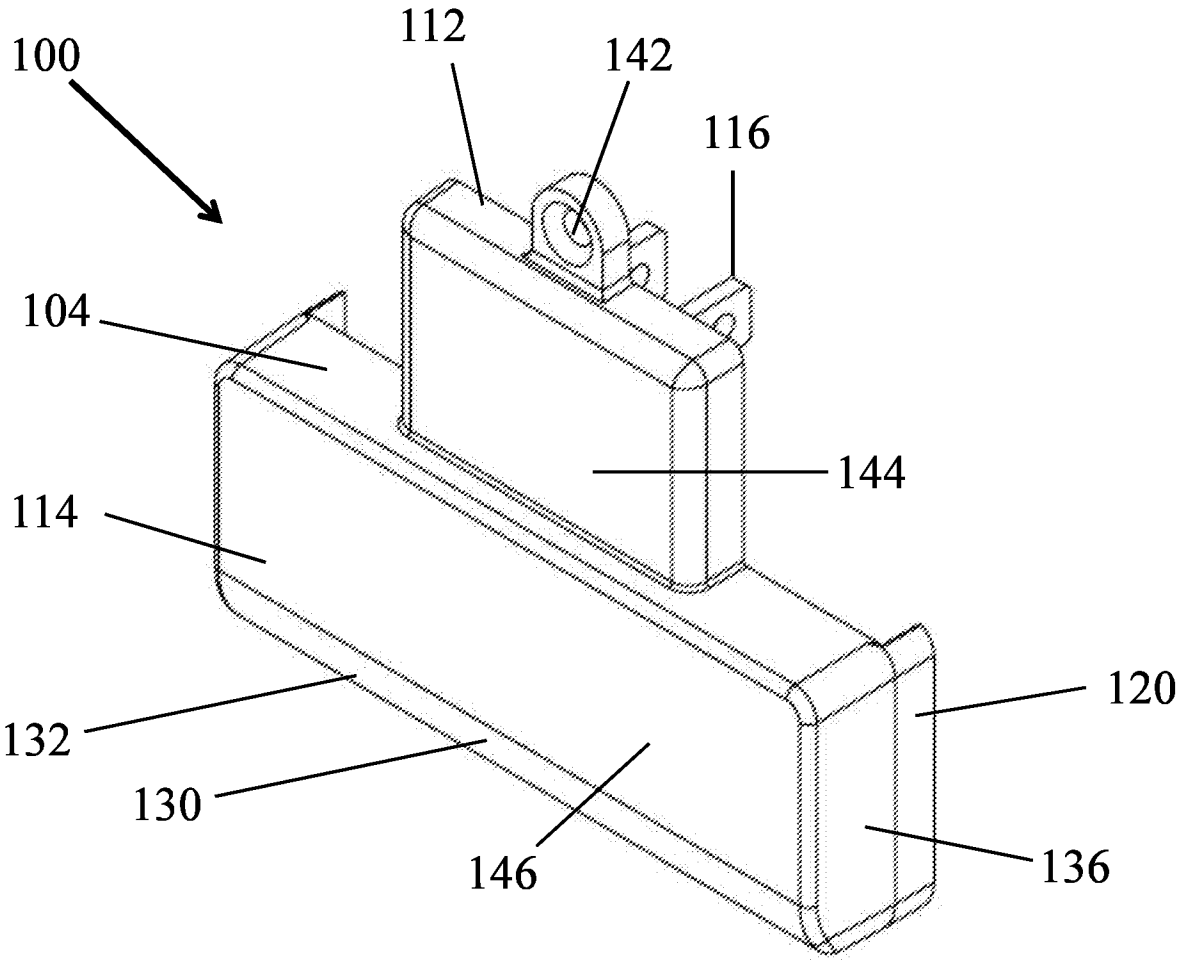
FIG. 28 is a front perspective view of another implementation of the plug-in module.
Figure 29:
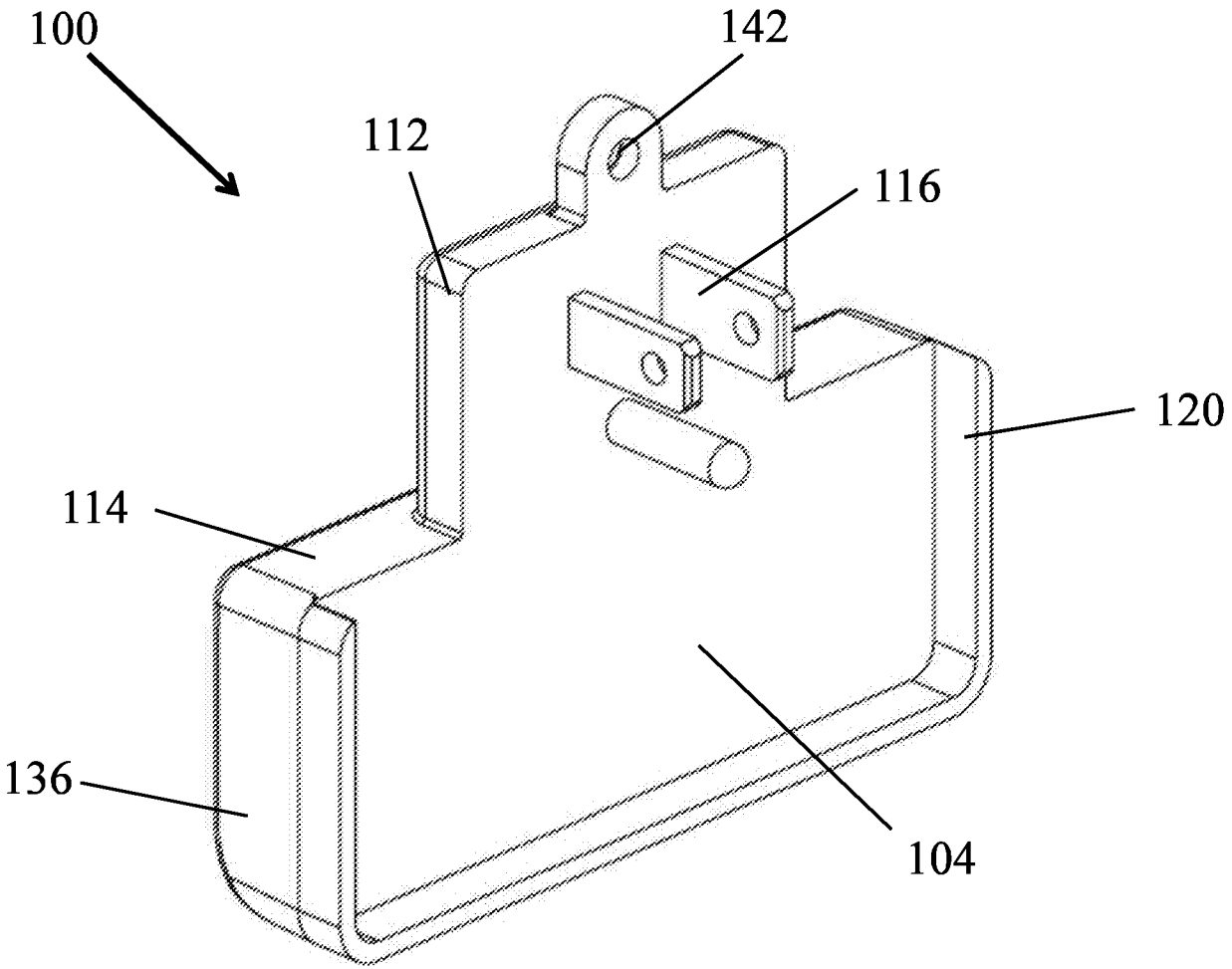
FIG. 29 is a rear perspective view of the plug-in module of FIG. 28.
Figure 32:
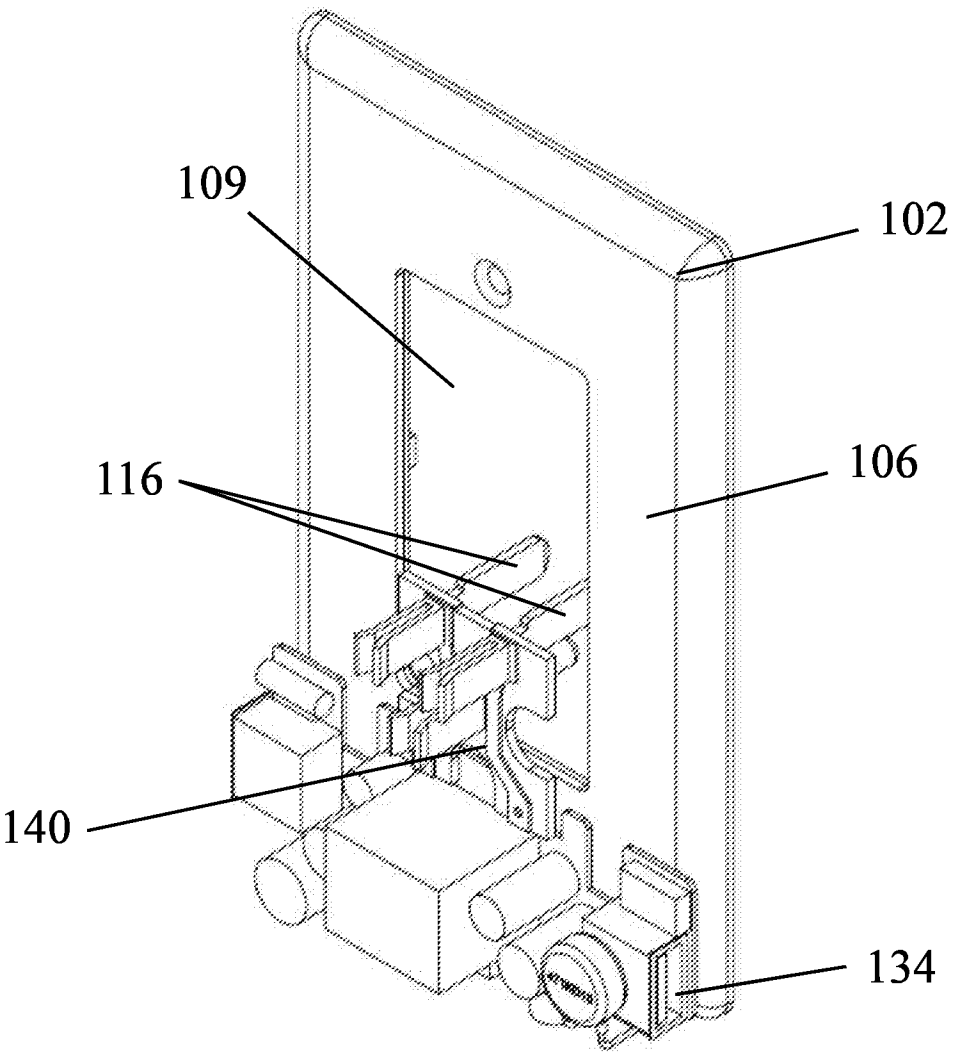
FIG. 32 is a perspective view of the plug-in module of FIG. 28 with the electrical box surfaces removed to expose the internal circuit.

The module cover 114 is coupled to and located adjacent to the electrical plug 112 and has a surround 120 configured to extend around a portion of the perimeter of the wall plate 102 when the plug-in module 104 is mated with the electrical receptacle 118. The module cover 114 also has a circuit 122 contained within the module cover 114 that is electrically coupled to the electrical prongs 116 (see FIG. 32). The portion of the wall plate 102 that is covered by the surround 120 may be a bottom edge 124, a portion of a right edge 126, and a portion of a left edge 128 of the wall plate 102. As shown in FIGS. 27A-27C, the module cover 114 may also have a light 130 located along a bottom edge 132 of the module cover 114 (see FIG. 27C) and may have a USB port 134 exposed on a surface 136 of the module cover 114 (see FIG. 27B). The surface 136 may be a side surface. The light 130 may be an LED light. The USB port 134 may face perpendicular to the front surface 106. In implementations with a USB port 134 or a light 130, the circuit 122 may be electrically coupled to the USB port 134 and light 130 and configured to provide power to these components when power is supplied to the electrical prongs 116 (see FIG. 32).

Figure 30:
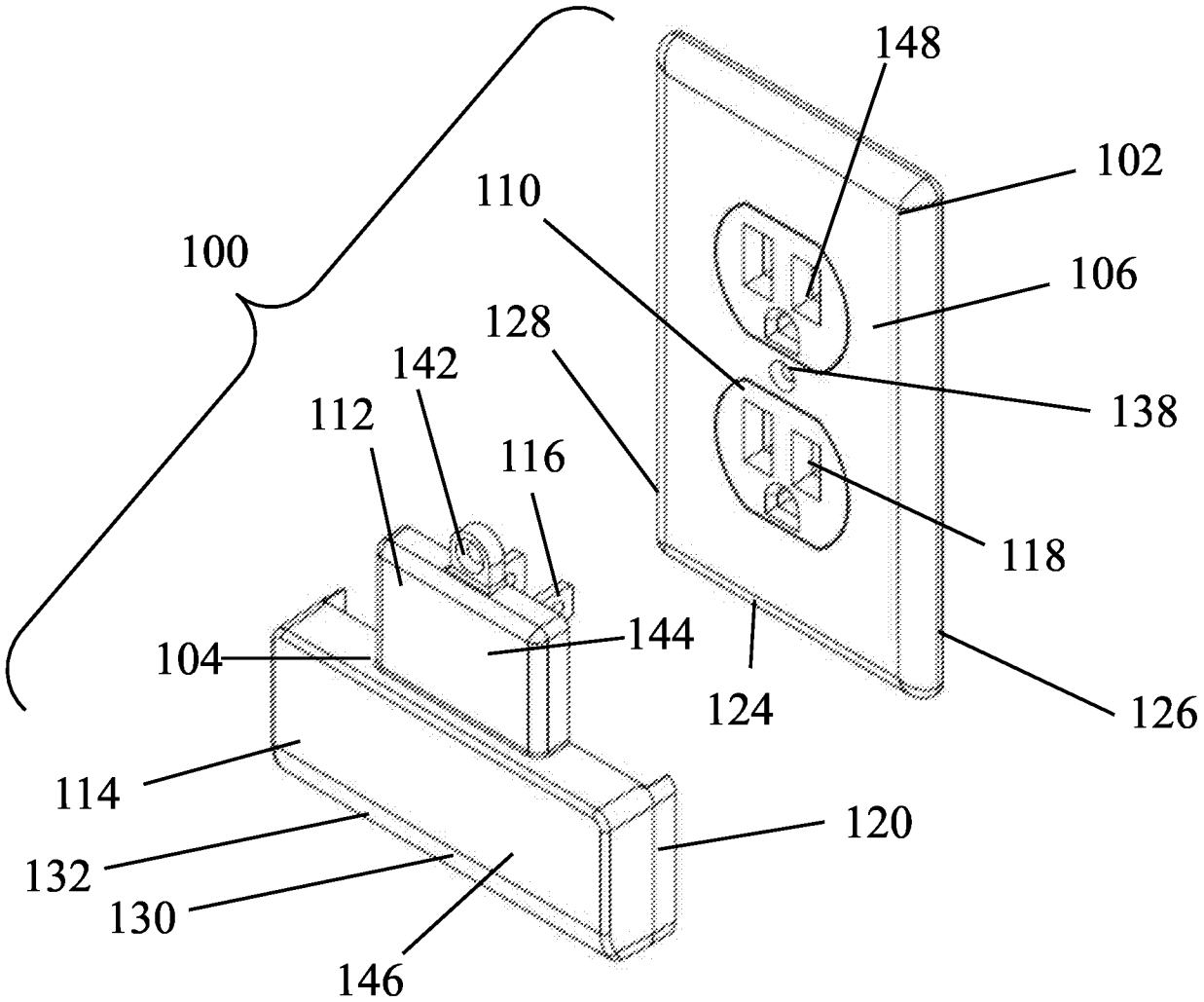
FIG. 30 is an exploded view of the plug-in module of FIG. 28 with a wall plate and electrical device.
Figure 31:
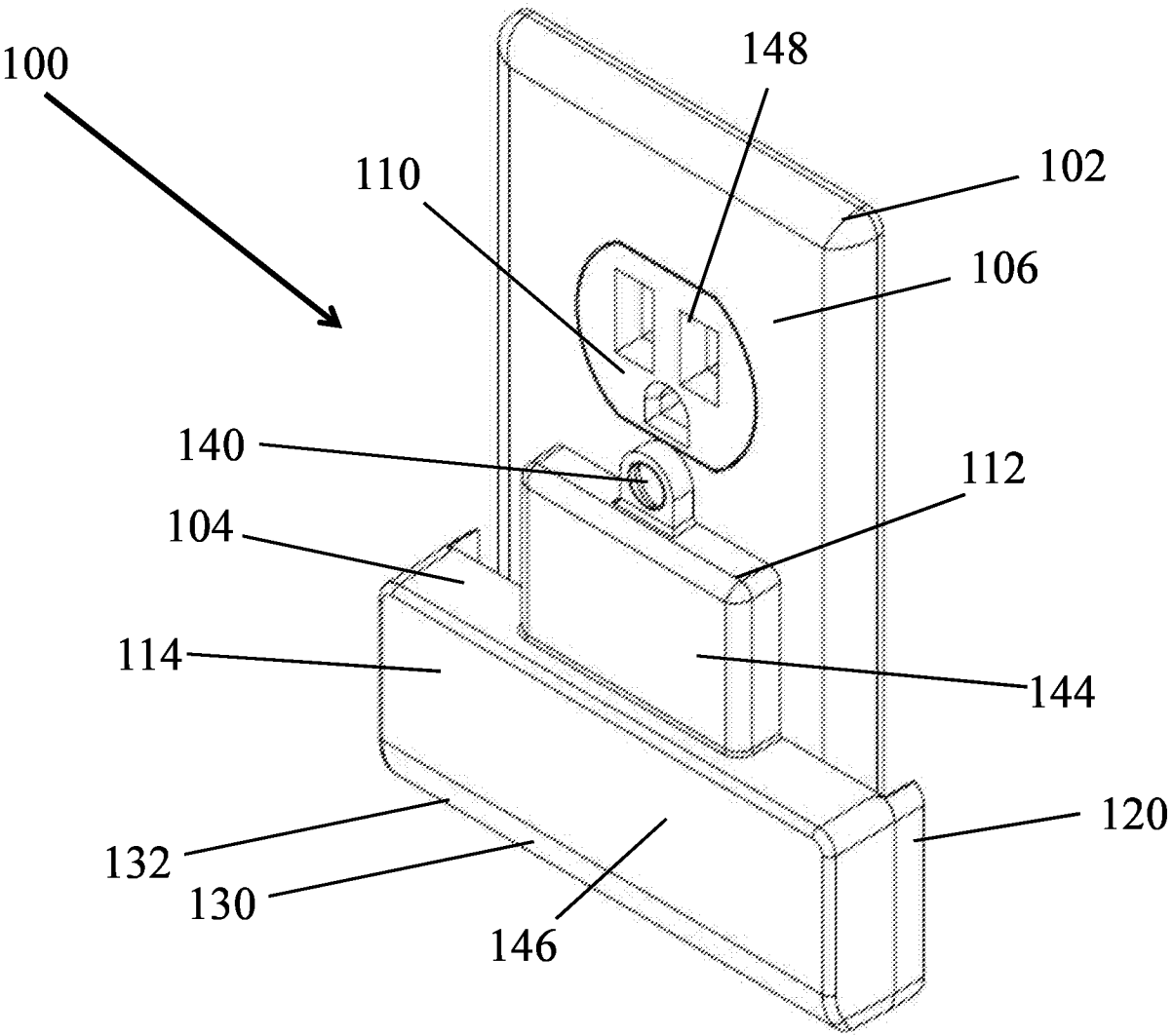
FIG. 31 is a perspective view of the plug-in module of FIG. 28 assembled with a wall plate and electrical device.

As illustrated in FIGS. 25 and 30, the wall plate 102 may also have a first mounting screw aperture 138 extending through the wall plate 102. The first mounting screw aperture 138 is configured to receive a mounting screw 140 to attach the wall plate 102 to the electrical device 110. The plug-in module 104 may also have a second mounting screw aperture 142 extending through the plug-in module 104. The second mounting screw aperture 142 is configured to receive the mounting screw 140 to attach the plug-in module 104 to the wall plate 102 and the electrical device 110. In some implementations, the mounting screw 140 extends through both the first mounting screw aperture 138 and the second mounting screw aperture 142. The second mounting screw aperture 142 may be located above the electrical plug 112 (see FIG. 28), or may be located in the module cover 114 and adjacent to the electrical plug 112 (see FIG. 23).

The electrical plug 112 has an electrical plug front surface 144 and the module cover 114 has an module cover front surface 146. The distance between the electrical plug front surface 144 and the front surface 106 may be smaller than the distance between the module cover front surface 146 and the front surface 106 (see FIG. 25B) when the plug-in module is mated with the electrical receptacle. The profile of the electrical plug 112 is smaller in such implementations, allowing a larger plug to be coupled with a second electrical receptacle 148 than could otherwise be accommodated.

It will be understood that implementations are not limited to the specific components disclosed herein, as virtually any components consistent with the intended operation of a method and/or system implementation for a powered wall plate may be utilized. Components may comprise any shape, size, style, type, model, version, class, grade, measurement, concentration, material, weight, quantity, and/or the like consistent with the intended operation of a method and/or system implementation for a powered wall plate.

The concepts disclosed herein are not limited to the specific implementations shown herein. For example, it is specifically contemplated that the components included in a particular implementation of a powered wall plate may be formed of any of many different types of materials or combinations that can readily be formed into shaped objects and that are consistent with the intended operation of a powered wall plate. For example, the components may be formed of: rubbers (synthetic and/or natural) and/or other like materials; polymers and/or other like materials; plastics, and/or other like materials; composites and/or other like materials; metals and/or other like materials; alloys and/or other like materials; and/or any combination of the foregoing.

Furthermore, embodiments of the powered wall plate may be manufactured separately and then assembled together, or any or all of the components may be manufactured simultaneously and integrally joined with one another. Manufacture of these components separately or simultaneously may involve extrusion, pultrusion, vacuum forming, injection molding, blow molding, resin transfer molding, casting, forging, cold rolling, milling, drilling, reaming, turning, grinding, stamping, cutting, bending, welding, soldering, hardening, riveting, punching, plating, and/or the like. If any of the components are manufactured separately, they may then be coupled or removably coupled with one another in any manner, such as with adhesive, a weld, a fastener, any combination thereof, and/or the like for example, depending on, among other considerations, the particular material(s) forming the components.

In places where the description above refers to particular implementations of a powered wall plate, it should be readily apparent that a number of modifications may be made without departing from the spirit thereof and that these implementations may be applied to other powered wall plate. The accompanying claims are intended to cover such modifications as would fall within the true spirit and scope of the disclosure set forth in this document. The presently disclosed implementations are, therefore, to be considered in all respects as illustrative and not restrictive, the scope of the disclosure being indicated by the appended claims rather than the foregoing description. All changes that come within the meaning of and range of equivalency of the claims are intended to be embraced therein.

What is claimed is:

1. A powered wall plate comprising:

a plug-in module configured to couple to a wall plate having a wall plate front surface opposite a rear surface, at least one opening extending through the wall plate front surface and the rear surface that is large enough to expose an electrical device therethrough, and a first mounting screw aperture extending through the wall plate and configured to receive a mounting screw to attach the wall plate to the electrical device, the plug-in module configured to extend forward from the wall plate front surface when mounted to the wall plate, the plug-in module comprising:

an electrical plug having an electrical plug front surface and at least two electrical prongs distinct from the electrical plug front surface and extending away from the electrical plug front surface in a first direction toward the electrical device, the at least two electrical prongs configured to removably mate with an electrical receptacle of the electrical device;

a module cover integrated with and immediately adjacent to the electrical plug, and positioned relative to the electrical plug in a second direction perpendicular to the first direction, the module cover having:

a module cover front surface;

a surround configured to extend around a bottom edge and a portion of a right edge and a portion of a left edge of the wall plate and leave exposed a different portion of the perimeter of the wall plate when the plug-in module is mounted to and extends across the front surface of the wall plate;

an LED light located along a bottom edge of the module cover;

a USB port exposed on a side surface of the module cover and facing perpendicular to the module cover front surface; and a circuit contained within the module cover, the circuit electrically coupled to the USB port, the at least two electrical prongs, and the LED light and configured to provide power to the USB port and the LED light when power is supplied to the at least two electrical prongs; and a second mounting screw aperture extending through the plug-in module, the second mounting screw aperture configured to receive the mounting screw to attach the plug-in module to the wall plate and the electrical device;

wherein a distance between the electrical plug front surface and the wall plate front surface is smaller than a distance between the module cover front surface and the wall plate front surface when the plug-in module is mounted to the wall plate.

2. The powered wall plate of claim 1, wherein the second mounting screw aperture is located above the electrical plug.

3. The powered wall plate of claim 1, wherein the second mounting screw aperture is located in the module cover adjacent to the electrical plug.

4. The powered wall plate of claim 1, wherein the module cover is located below the electrical plug.

5. A powered wall plate comprising a plug-in module, the plug-in module having:

an electrical plug having an electrical plug front surface and at least two electrical prongs distinct from the electrical plug front surface and extending away from the electrical plug front surface in a first direction, the at least two electrical prongs configured to removably mate with an electrical receptacle of an electrical device;

a module cover coupled to the electrical plug and positioned relative to the electrical plug in a second direction perpendicular to the first direction, the module cover comprising:

a module cover front surface;

a surround extending away from the module cover front surface and configured to extend around a portion of the perimeter of a wall plate surrounding the electrical device when the plug-in module is mated with the electrical receptacle and extends across a front surface of the wall plate; and a circuit contained within the module cover, the circuit electrically coupled to the at least two electrical prongs; and a second mounting screw aperture extending through the plug-in module, the second mounting screw aperture configured to receive a mounting screw to attach the plug-in module to the electrical device and to the wall plate;

wherein a distance between the electrical plug front surface and the front surface of the wall plate is smaller than a distance between the module cover front surface and the front surface of the wall plate when the plug-in module is mated with the electrical receptacle; and wherein the module cover further having a USB port exposed on a surface of the module cover.

6. The powered wall plate of claim 5, the module cover further having an LED light located along an edge of the module cover.

7. The powered wall plate of claim 6, the LED light being located along a bottom edge of the module cover.

8. The powered wall plate of claim 5, the USB port exposed on a surface perpendicular to the front surface.

9. The powered wall plate of claim 5, the surround configured to extend around a bottom edge and a portion of a right edge and a left edge of the wall plate when the plug-in module is mated with the electrical receptacle.

10. A powered wall plate, comprising a plug-in module, the plug-in module having:

an electrical plug having an electrical plug front surface and at least two electrical prongs distinct from the electrical plug front surface and extending away from the electrical plug front surface in a first direction, the at least two electrical prongs configured to removably mate with an electrical receptacle of an electrical device; and a module cover positioned relative to the electrical plug in a second direction perpendicular to the first direction, the module cover having:

a module cover front surface;

a surround extending away from the module cover front surface and configured to extend around a portion of the perimeter of a wall plate surrounding the electrical device when the plug-in module is mated with the electrical receptacle;

an LED light located along an edge of the module cover; and a circuit contained within the module cover, the circuit electrically coupled to the at least two electrical prongs;

wherein the wall plate has a front surface and the distance between the electrical plug front surface and the front surface of the wall plate is smaller than the distance between the module cover front surface and the front surface of the wall plate when the plug-in module is mated with the electrical receptacle.

11. The powered wall plate of claim 10, further comprising a second mounting screw aperture extending through the plug-in module, the second mounting screw aperture configured to receive a mounting screw to attach the plug-in module to the electrical device and to the wall plate, wherein the second mounting screw aperture is located above the electrical plug.

12. The powered wall plate of claim 10, further comprising a second mounting screw aperture extending through the plug-in module, the second mounting screw aperture configured to receive a mounting screw to attach the plug-in module to the electrical device and to the wall plate, wherein the second mounting screw aperture is located in the module cover adjacent to the electrical plug.

13. The powered wall plate of claim 10, wherein the module cover is located below the electrical plug.

14. The powered wall plate of claim 10, the LED light being located along a bottom edge of the module cover.

15. The powered wall plate of claim 10, the surround configured to extend around a bottom edge and a portion of a right edge and a left edge of the wall plate when the plug-in module is mated with the electrical receptacle.

16. A powered wall plate, comprising a plug-in module, the plug-in module having:

an electrical plug having an electrical plug front surface and at least two electrical prongs distinct from the electrical plug front surface and extending away from the electrical plug front surface in a first direction, the at least two electrical prongs configured to removably mate with an electrical receptacle of an electrical device; and a module cover positioned relative to the electrical plug in a second direction perpendicular to the first direction, the module cover having:

a module cover front surface;

a surround extending away from the module cover front surface and configured to extend around a portion of the perimeter of a wall plate surrounding the electrical device when the plug-in module is mated with the electrical receptacle;

a circuit contained within the module cover, the circuit electrically coupled to the at least two electrical prongs; and a USB port exposed on a surface of the module cover;

wherein the wall plate has a front surface and the distance between the electrical plug front surface and the front surface of the wall plate is smaller than the distance between the module cover front surface and the front surface of the wall plate when the plug-in module is mated with the electrical receptacle.

17. The powered wall plate of claim 16, the USB port exposed on a surface perpendicular to the module cover front surface.

18. The powered wall plate of claim 16, further comprising a second mounting screw aperture extending through the plug-in module, the second mounting screw aperture configured to receive a mounting screw to attach the plug-in module to the electrical device and to the wall plate, wherein the second mounting screw aperture is located above the electrical plug.

19. The powered wall plate of claim 16, further comprising a second mounting screw aperture extending through the plug-in module, the second mounting screw aperture configured to receive a mounting screw to attach the plug-in module to the electrical device and to the wall plate, wherein the second mounting screw aperture is located in the module cover adjacent to the electrical plug.

* * * * *